US009392892B2

(12) United States Patent
Wong

(10) Patent No.: US 9,392,892 B2
(45) Date of Patent: Jul. 19, 2016

(54) LID ASSEMBLY AND DRINKING CONTAINER COMPRISING THE SAME

(71) Applicant: AEGIS GLOBAL RESOURCES (HK) LIMITED, Hong Kong (HK)

(72) Inventor: Sui Wah Wong, Hong Kong (HK)

(73) Assignee: AEGIS Global Resources (HK) Limited, Hong Kong (CN)

( * ) Notice: Subject to any disclaimer, the term of this patent is extended or adjusted under 35 U.S.C. 154(b) by 0 days.

(21) Appl. No.: 14/517,659

(22) Filed: Oct. 17, 2014

(65) Prior Publication Data

US 2016/0106241 A1 Apr. 21, 2016

(51) Int. Cl.

| | |
|---|---|
| ***B65D 51/18*** | (2006.01) |
| ***A47G 19/22*** | (2006.01) |
| ***B65D 43/02*** | (2006.01) |
| ***B65D 43/16*** | (2006.01) |
| ***B65D 43/26*** | (2006.01) |
| ***B65D 47/32*** | (2006.01) |

(52) U.S. Cl.

CPC ..... *A47G 19/2272* (2013.01); *B65D 43/02* (2013.01); *B65D 43/16* (2013.01); *B65D 43/265* (2013.01); *B65D 47/32* (2013.01); *B65D 51/18* (2013.01); *B65D 2251/009* (2013.01); *B65D 2251/0021* (2013.01); *B65D 2251/0028* (2013.01); *B65D 2251/0081* (2013.01); *B65D 2543/00046* (2013.01); *B65D 2543/00888* (2013.01)

(58) Field of Classification Search

CPC ..... A47G 19/2272; A47G 23/16; B65D 2543/00046; B65D 47/249; B65D 47/32; B65D 51/18; B65D 41/28; B65D 43/16; A45F 3/16

USPC ..... 220/254.1, 254.3, 254.5; 222/470

See application file for complete search history.

(56) References Cited

U.S. PATENT DOCUMENTS

| | | | | |
|---|---|---|---|---|
| 8,056,745 | B2 * | 11/2011 | Yu | A47J 41/0027 215/356 |
| 8,376,162 | B2 * | 2/2013 | Yang | B65D 47/249 215/244 |
| 8,602,238 | B2 * | 12/2013 | El-Saden | B65D 47/066 215/389 |
| 8,960,490 | B2 * | 2/2015 | Carlile | B65D 47/249 220/254.5 |
| 2008/0277020 | A1 * | 11/2008 | Windmiller | B65D 1/06 141/113 |
| 2015/0173539 | A1 * | 6/2015 | Mason | A47G 19/2272 220/707 |

* cited by examiner

*Primary Examiner* — Shawn M Braden
(74) *Attorney, Agent, or Firm* — Nyemaster Goode, P.C.

(57) ABSTRACT

The present invention relates to a lid assembly for a drinking container, the lid assembly comprising a drinking orifice, a gas vent, and a mechanism to ensure that the drinking orifice can be opened only after the gas vent is opened. Furthermore, the present invention provides a lid assembly for a drinking container, which lid assembly allows for easy disassembling for purposes such as cleaning the inside of the lid assembly.

25 Claims, 20 Drawing Sheets

LID ASSEMBLY AND DRINKING CONTAINER COMPRISING THE SAME

TECHNICAL FIELD OF THE INVENTION

This invention relates generally to a drinking container, and particularly, to a drinking container that comprises respective closing and triggering mechanisms for the drinking and gas vents thereof.

BACKGROUND OF THE INVENTION

Various drinking containers that are able to keep the fluids contained therein warm exist in the art. These containers are usually comprised of a lid secured to a container body, the lid having a drinking orifice through which the fluid flows from the container into the drinker's mouth. When drinking a hot fluid from the container, the hot air contained in the container often rushes out of the drinking orifice together with the fluid, and spurts onto the drinker's face, causing discomfort.

To solve this problem some of the recent drinking containers comprise a gas vent formed in the lid through which the hot air inside the container exits, and a mechanism to open and close the gas vent. Generally, some of these containers are configured to open simultaneously the gas vent and the drinking orifice, and there is no time for the hot air to escape through the gas vent before the drinker drinks the liquid from the drinking orifice. Other containers require the drinker to perform an extra operation (for example, switching a switch) to manually open the gas vent. This design may have a problem that the drinker forgets to open the gas vent before drinking the liquid, disabling the function of the gas vent.

Therefore, there is a need for a drinking container that comprises a mechanism to ensure that the user opens the gas vent before opening the drinking orifice to drink the liquid from the container.

SUMMARY OF THE INVENTION

One of the principle objects of the invention is to provide a drinking container that comprises a mechanism to ensure that the drinking orifice can only be opened only after the gas vent is opened.

Another object of the invention is to provide a lid assembly for a drinking container, which lid assembly can be easily disassembled for purposes of, for example, cleaning the inside of the lid assembly.

These and other objects are satisfied by the present invention, which provides a lid assembly for a drinking container, which lid assembly may comprise:

an upper lid member comprising a drinking orifice and a gas vent formed therethrough;

a closure member pivotally mounted on a top surface of the upper lid member for pivotal movement to close and open the gas vent;

a lower lid member having a window in fluid communication with the drinking orifice and the gas vent to allow a flow of liquid and gas therethrough;

a lever pivotally mounted on the lower lid member;

a baffle plate for closing the drinking orifice and mounted atop the lever to move pivotally along with the pivotal movement of the lever; and a piston movable within the upper lid member in a direction in order to pivotally move the lever downwardly so that the baffle plate moves away from the drinking orifice, said piston having a piston head exposed externally;

wherein the piston is configured such that the piston is permitted to enable the pivotal movement of the lever only when the closure member is moved to open the gas vent.

In one embodiment of the present invention, the piston may extend through a piston passage formed through a side wall of the upper lid member, and may be configured such that an inner end of the piston abuts against the lever and moves to force the lever to pivot downwardly. Preferably, a torsion spring may be provided to constantly apply an upward pressure to the lever.

In one embodiment of the present invention, a groove may be formed on an upper side of the piston, and an opening may be formed on an upper side of the piston passage and positioned to correspond to the groove so as to allow for housing of a part of the closure member in the groove for prevention of the movement of the piston when the gas vent is closed. A recess formed on the closure member may be adapted to face away from the groove when the gas vent is closed, and adapted to face the groove to allow for the movement of the piston when the closure member is moved to open the gas vent. Preferably, a piston spring may be provided to constantly apply an outward pressure to the piston head.

In one embodiment of the present invention, the closure member may comprise a hinge and a closure plate extending from the hinge, the closure member being mounted on the top surface of the upper lid member in such a manner that the closure plate is pivotal around the hinge.

In one embodiment of the present invention, the gas vent may be formed with an opening direction thereof perpendicular to a longitudinal direction of the hinge, and the lid assembly may comprise a pin protruding beyond the gas vent and received in a niche formed on the hinge to close the gas vent, and the pin being caused to disengage from the niche by the pivotal movement of the closure member and pressed by the closure member to move down away from the gas vent to create a venting space together with the gas vent. Preferably, the pin may be slidably supported by a holder secured below the gas vent to an inner surface of the upper lid member, and a resilient ring may be provided to surround the pin and push the pin to move up when pressed.

In another embodiment of the present invention, the gas vent may be formed with an opening direction thereof in parallel with a longitudinal direction of the hinge, the lid assembly may comprise a pin protruding beyond the gas vent and having a first cam face in corporation with a second cam face formed on an end of the hinge to close the gas vent, wherein a flat surface of the hinge adjoining the second cam face rotates with the pivotal movement of the closure member to force against the first cam face of the pin, so that at least a part of the pin is pushed to move away from the gas vent to create a venting space together with the gas vent. Preferably, a resilient member may be coupled to an opposite end of the pin to the first cam face in order to operably push the pin towards the gas vent.

In one embodiment of the present invention, the lower lid member may be mounted to the upper lid member in a detachable manner. Preferably, the lid assembly may further comprise a lock mechanism for detachably locking the upper and lower lid members together. The lock mechanism may comprise a hook member extending downwardly from the upper lid member; an unlocking member comprising a body extending through the lower lid member and having a hooked head, and a grip portion extending from the body and restrained below the low lid member; and a hook linkage pivotally mounted on the lower lid member and between the hook member and the unlocking member, the hook linkage configured to have a respective slot formed on opposite side surfaces thereof or a respective hooked end on opposite ends thereof, which are engagable with the hook member and the hooked head; wherein a downward movement of the grip portion drives the hooked head to cause the hook linkage to pivot downwardly and to disengage from the hook member to allow the lower lid member to be detached from the upper lid member. Preferably, a resilient block may be placed below the hook linkage to apply an upward pressure to the hook linkage.

In another embodiment of the present invention, a handle may be pivotally mounted to a bottom surface of the lower lid member to facilitate detachment of the lower lid member from the upper lid member.

In one embodiment of the present invention, the window may comprise a main portion and a notch, and a blocking member, which for example takes shape of a ball, may be seated on the window and dimensioned so as to block the main portion with the notch remaining open. Preferably, a restraint having a profile matchable with the blocking member may be provided for restraining the movement of the blocking member.

In another embodiment of the present invention, the blocking member may be shaped to have a stem extending through the window, a top flange extending from one end of the stem, a bottom flange extending from the other end of the stem and sized to fully cover the window, and a constricted spring coiled about the stem and carried on the stem below the top flange so that it acts to bias the bottom flange to fully cover the window, wherein the top flange comes into contact with the lever and is caused to move downwardly when the lever is forced to pivot downwardly by the piston, thereby driving to move the bottom flange away from the window. Preferably, a hollow cylinder for allowing passage of a lower part of the stem may be secured within the window by a plurality of connectors formed on an inner surface of the window, and the hollow cylinder may be sized such that the constricted spring coiled about an upper part of the stem is carried between the hollow cylinder and the top flange. Preferably, a blocking ring is secured on top of the bottom flange and is caused to press against a bottom surface of the lower lid member by the constricted spring to block the window.

In another embodiment of the present invention, the lever may be configured to comprise a first pivoting member having an arm on which the baffle plate is mounted, and a second pivoting member. The second pivoting member is adapted to be acted on by the piston to pivot downwardly thereby causing downward movement of the blocking member so as to expose the window; and the first pivoting member is configured to remain immobilized while the second pivoting member moves to expose the window, and after the window is exposed, is caused to pivot downwardly with the baffle plate moving away from the drinking orifice. Preferably, the first pivoting member may comprise two spaced apart legs extending from the arm and pivotally mounted on the lower lid member; and the second pivoting member protrudes beyond the two legs such that the inner end of the piston moves to act on the second pivoting member only which is caused to pivot downwardly in a space defined by the two legs until the second pivoting member presses towards the first pivoting member causing the first pivoting member to pivot downwardly together.

Another aspect of the present invention provides a drinking container comprising a container body in which a cavity is formed, and a lid assembly of the present invention detachably secured on top of the container body. Preferably, the container body may comprise a dual wall structure comprised of an inner wall component and an outer wall component.

In one embodiment of the present invention, the lid assembly may further comprise an intermediate bracket secured around a periphery of the low lid member and having external threads formed on an outer surface thereof, which external threads cooperate with internal threads formed on an inner surface of the inner wall component to secure the lid assembly to the container body.

DETAILED DESCRIPTION OF THE INVENTION

While this invention is illustrated and described in preferred embodiments, the drinking container of the present invention may be produced in many different configurations, sizes, forms and materials.

Figures 1A, 1B, 1C:
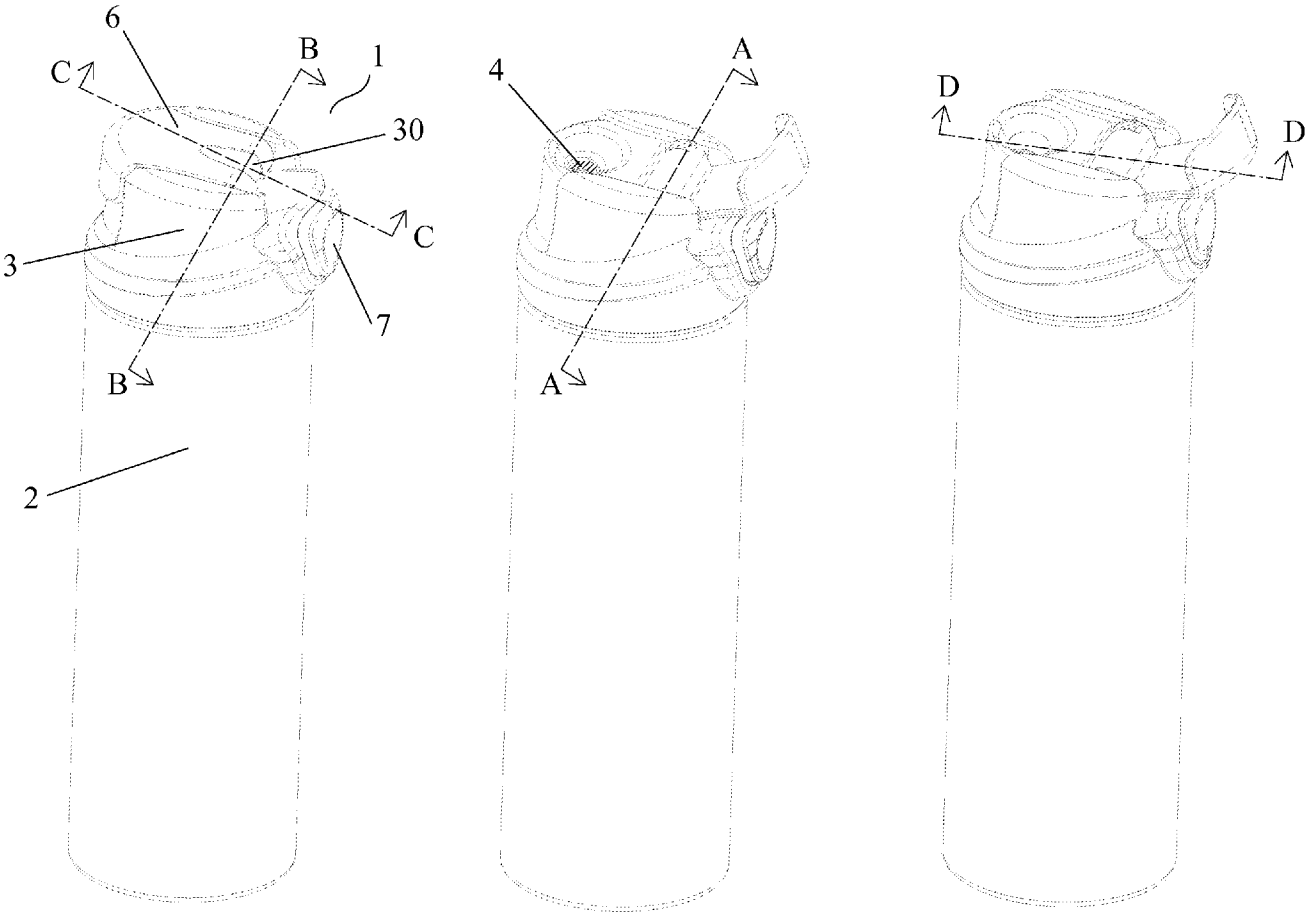
FIG. 1A is a perspective view of a container according to an embodiment of the present invention, wherein both the drinking orifice and the gas vent are closed.
FIG. 1B is a perspective view of the container shown in FIG. 1A wherein the drinking orifice is closed and the gas vent is open.
FIG. 1C is a perspective view of the container shown in FIG. 1A wherein both the drinking orifice and the gas vent are open.

Referring now to the drawings, FIGS. 1A-1C illustrate in a perspective view a drinking container according to a first preferred embodiment of the present invention in three different states respectively. The container 1 is generally comprised of a container body 2 for accommodating liquid, and a lid assembly 3 that can be detachably secured on top of the container body 2. As can be seen in FIGS. 1B and 1C, a drinking orifice 4 for drinking the liquid accommodated in the container body 2, and a gas vent 5 (see FIGS. 5 and 6) for releasing the gas in the container, are formed on the lid assembly 3.

The lid assembly 3 comprises a closure member 6 and a piston 27 having a piston head 7. The closure member 6 is configured to be pivotally movable between a fully closed position as shown in FIG. 1A where the gas vent 5 is fully closed, and a fully open position as shown in FIGS. 1B and 1C where the gas vent 5 is fully open. The piston 27 is configured in such a manner that when the piston head 7 is pressed, as shown in FIG. 1C, the drinking orifice 4 is caused by the piston 27 to be opened, and when the piston head 7 is released, as shown in FIG. 1B, the piston 27 moves in a direction towards the piston head 7 to cause the drinking orifice 4 closed.

Preferably, the closure member 6 and the piston 27 are configured in such a manner that only when the closure member 6 is in the open position can the piston head 7 be pressed to cause the piston 27 to move. In other words, the drinking orifice 4 can be opened only when the gas vent 5 is open. Such a configuration is advantageous, especially in the case of drinking hot liquid from the container, because it ensures that the hot gas in the container exits from the gas vent 5 before the drinking orifice 4 is allowed to open, preventing the hot gas from spurting out the drinking orifice 4 and at the user.

Figure 2:
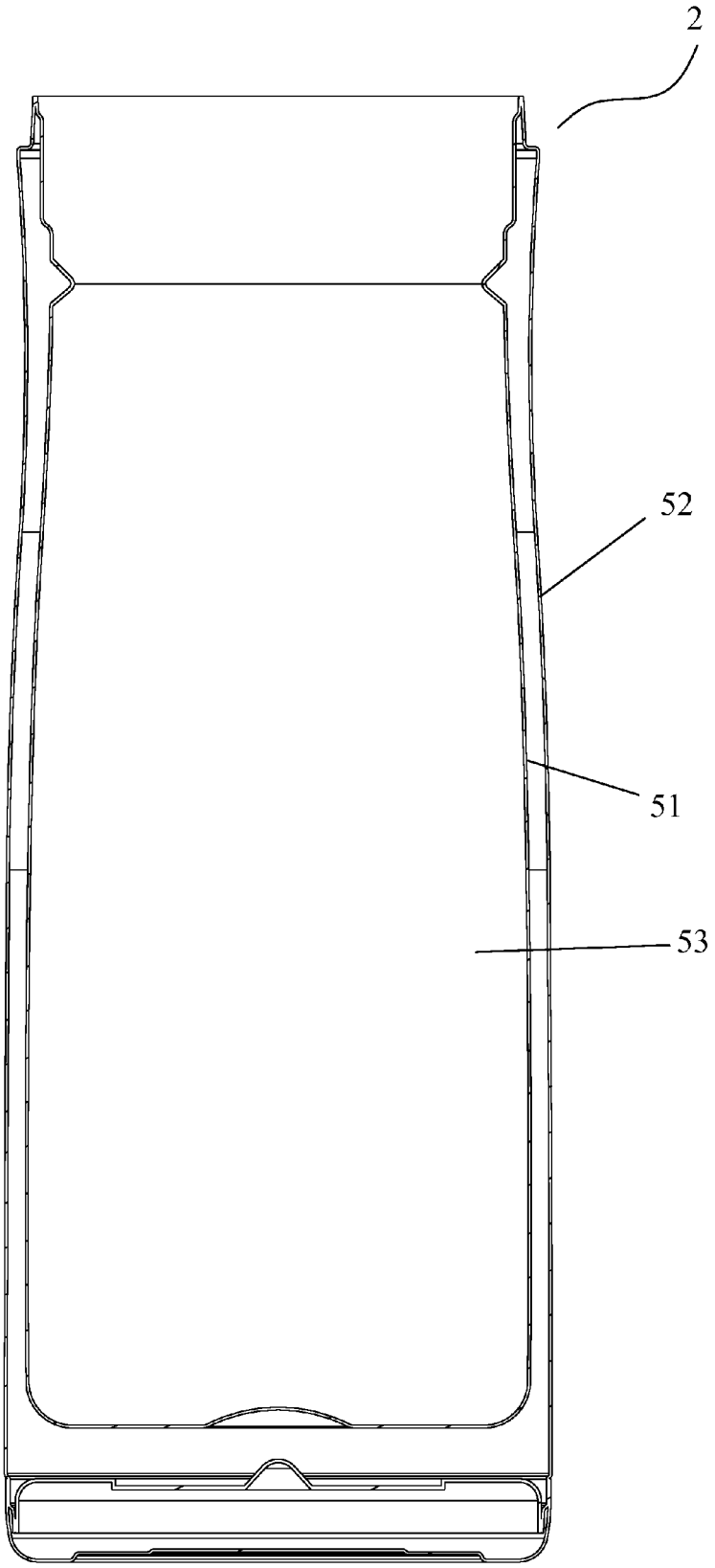
FIG. 2 is a cross sectional view of the container body of a container according to an embodiment of the present invention.

As shown in FIG. 2, the container body 2 is formed of a dual-walled structure comprising an inner wall component 51 and an outer wall component 52, with a cavity 53 formed inside the inner wall component 51.

Now referring to FIG. 3, the lid assembly 3 is comprised of a number of components, including an upper lid member 8, an intermediate bracket 9 and a lower lid member 10, which are assembled together in a detachable manner by means of a lock mechanism (which will be discussed in details below) to constitute the main structure of the lid assembly 3. The intermediate bracket 9 secured around a periphery of the low lid member (10) takes the shape of a ring, and comprises external threads formed on an outer surface thereof, which cooperate with internal threads formed on an inner surface of the inner wall component 51 of the container body 2 to secure the lid assembly 3 to the container body 2.

Figure 4:
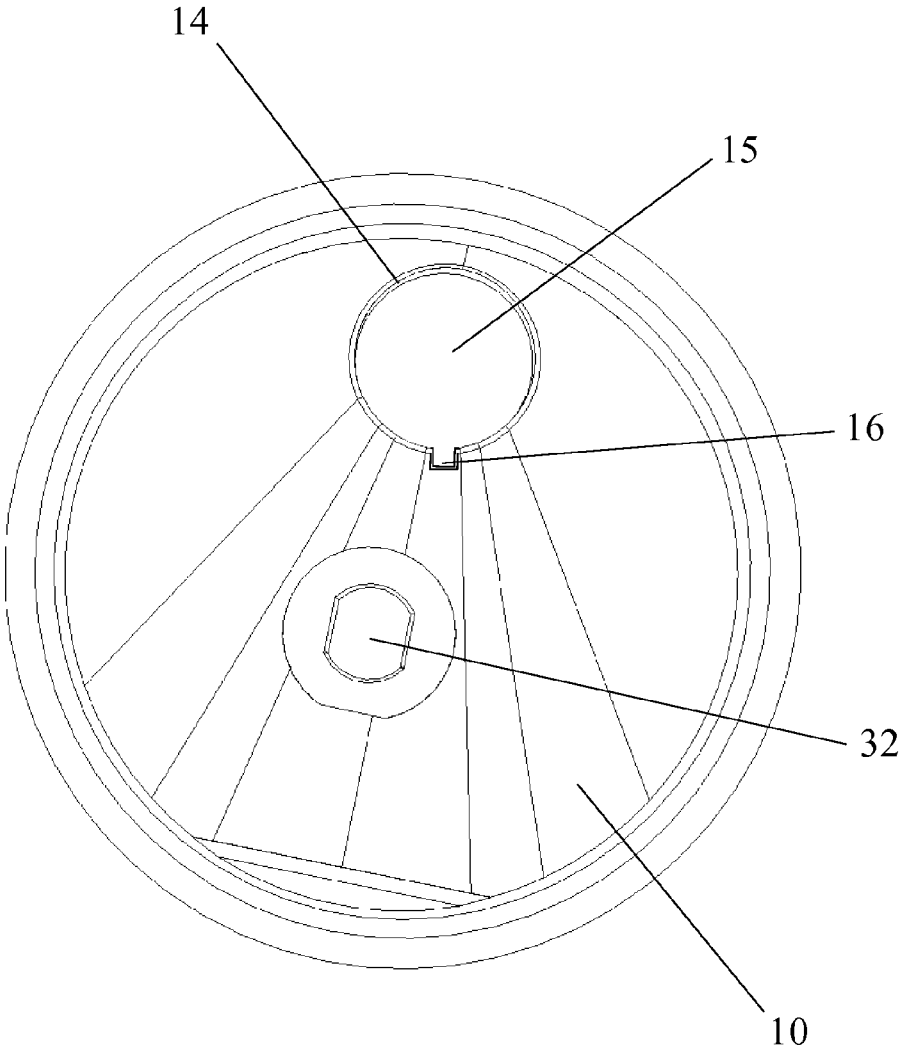
FIG. 4 is a bottom view of the lower lid member according to an embodiment of the present invention.

The lower lid member 10 comprises an upper plate 11 and a lower plate 12 formed integrally with a connecting member 13 therebetween. A window 14 allowing a flow of liquid and gas therethrough is formed through both the upper plate 11 and the lower plate 12 and is in fluid communication with the drinking orifice 4 and the gas vent 5. As shown in FIG. 4, the window 14 comprises a circular main portion 15 and a relatively small notch 16 formed on the edge of the main portion 15. When the container 1 is in an upright state, a blocking member 17, preferably a ball is movably seated on the window 14, and dimensioned so as to block the main portion 15, with the notch 16 remaining open. When the container 1 is tilted to allow the user to drink the liquid inside the cavity 53 of the container body 2, the ball would move to leave the window uncovered partially or fully and the liquid is allowed to flow through the window 14 out of the container body 2. When the drinking operation is finished and the container 1 is put back into the upright state, the blocking member 17 returns to be seated on the window 14, blocking the main portion 15 with the notch 16 remaining open. Such a design helps to maintain the temperature of the liquid in the container 1, while allowing the hot gas to escape from the cavity 53 into the lid assembly 3 through the notch 16.

Figure 11:
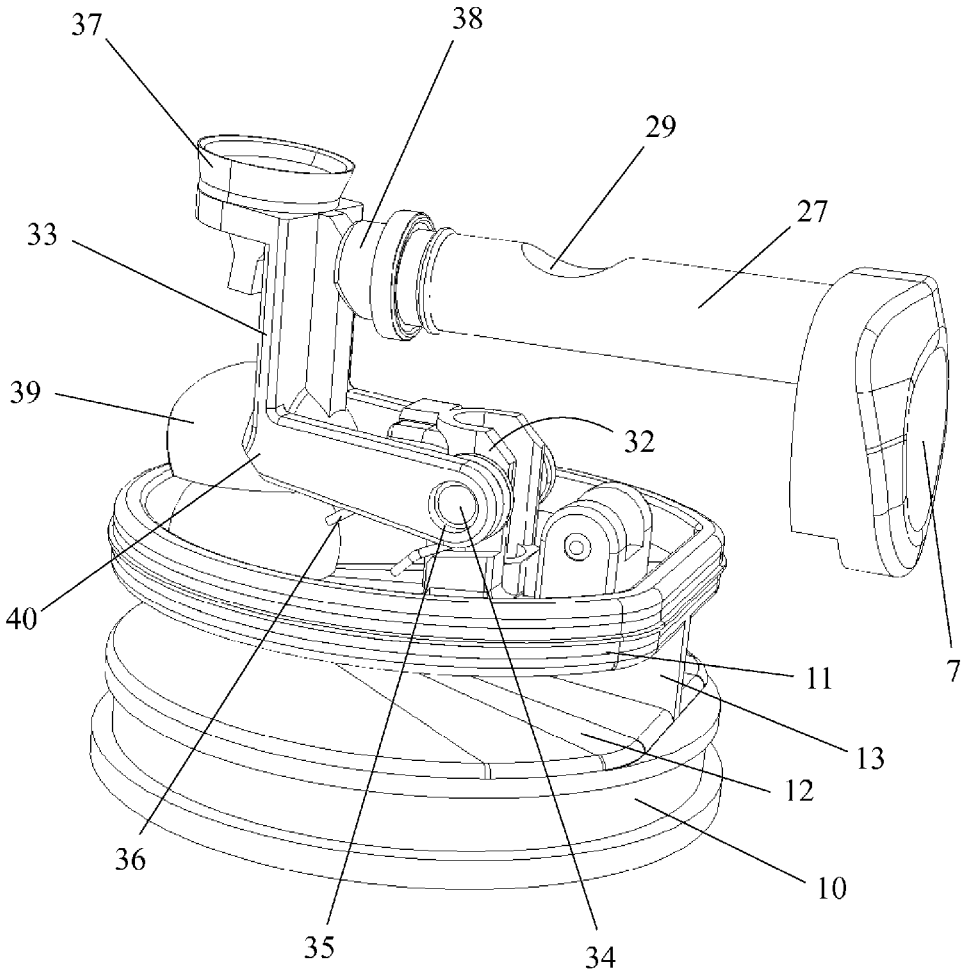
FIG. 11 is a perspective view of the lid assembly with the upper lid member and the closure member removed.
Figure 12A:
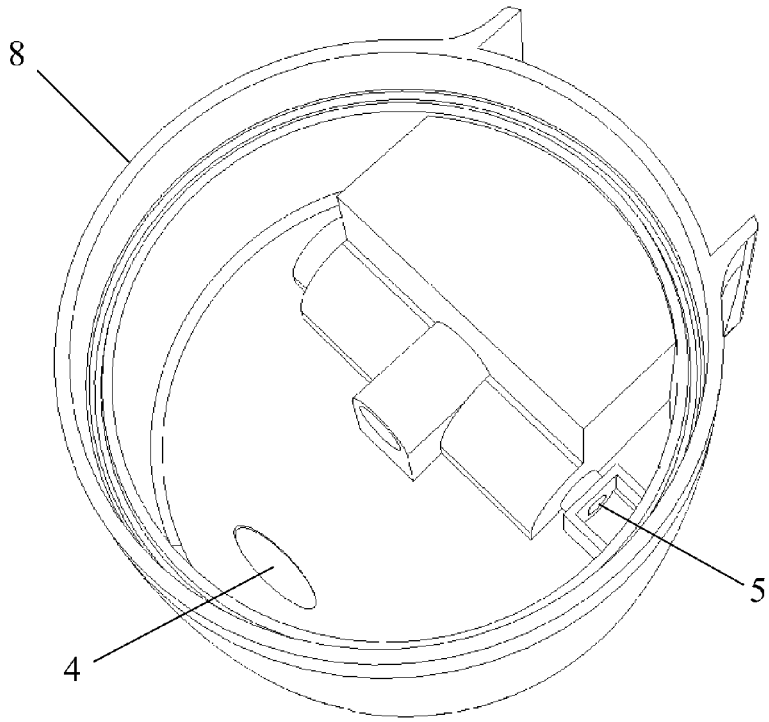
FIG. 12A is a bottom perspective view of the upper lid member according to an alternative embodiment of the present invention.
Figure 12B:
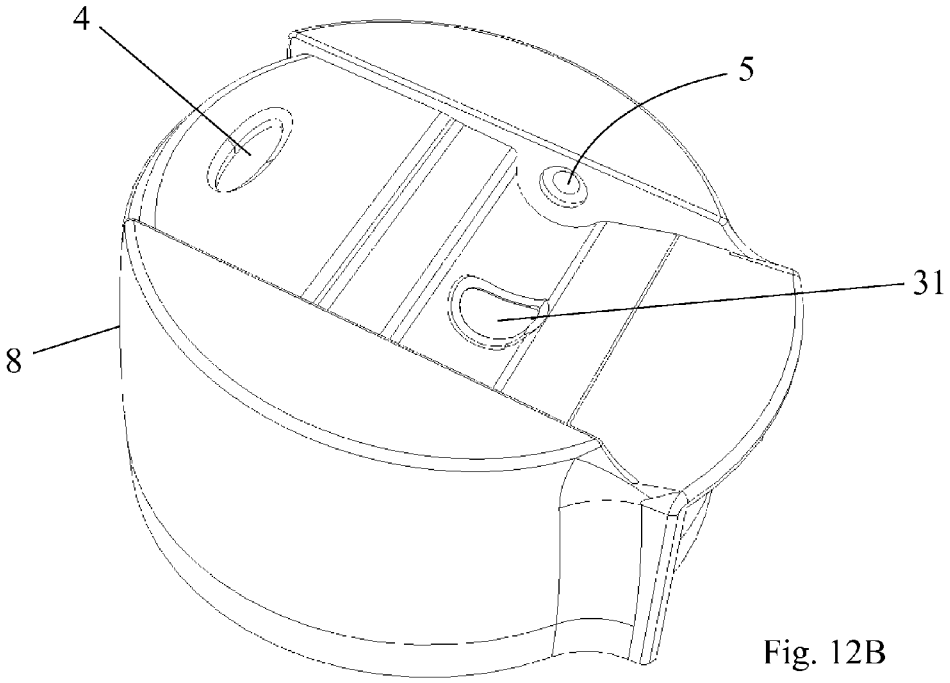
FIG. 12B is a top perspective view of the upper lid member shown in FIG. 12A.
Figure 13A:
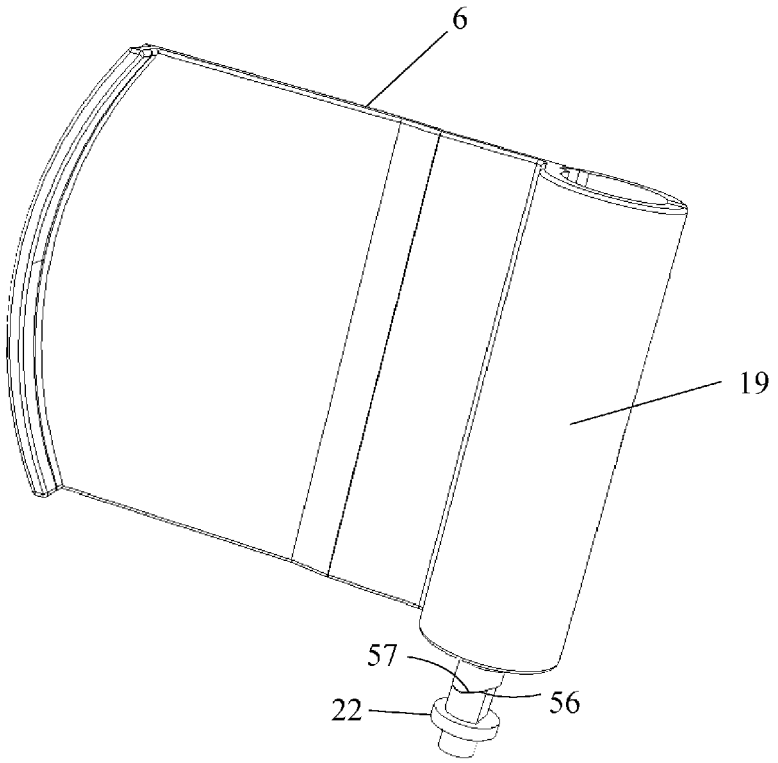
FIG. 13A is a perspective view of the closure member and the pin according to an alternative embodiment of the present invention, with the gas vent in the closed position.
Figure 13B:
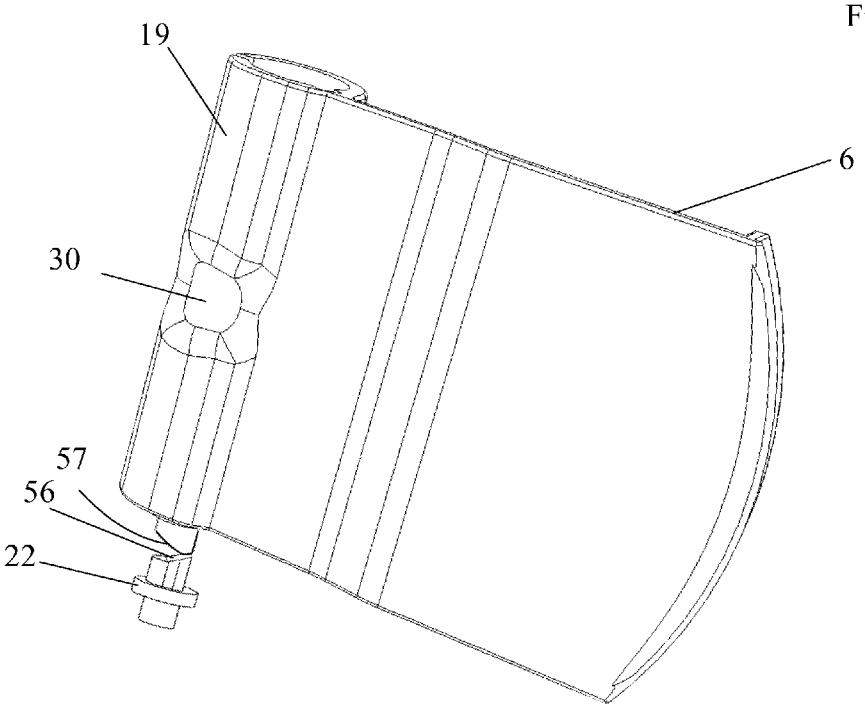
FIG. 13B is a perspective view of the closure member and the pin shown in FIG. 13A, with the gas vent in the open position.

Preferably, as shown in FIG. 11, a restraint 39 configured in shape and size to be matchable with the ball is provided at the turning point 40 of the L-shaped lever 33. This restraint 39 serves to restrain or guide the movement of the blocking member 17 within the defined space.

Figure 3:
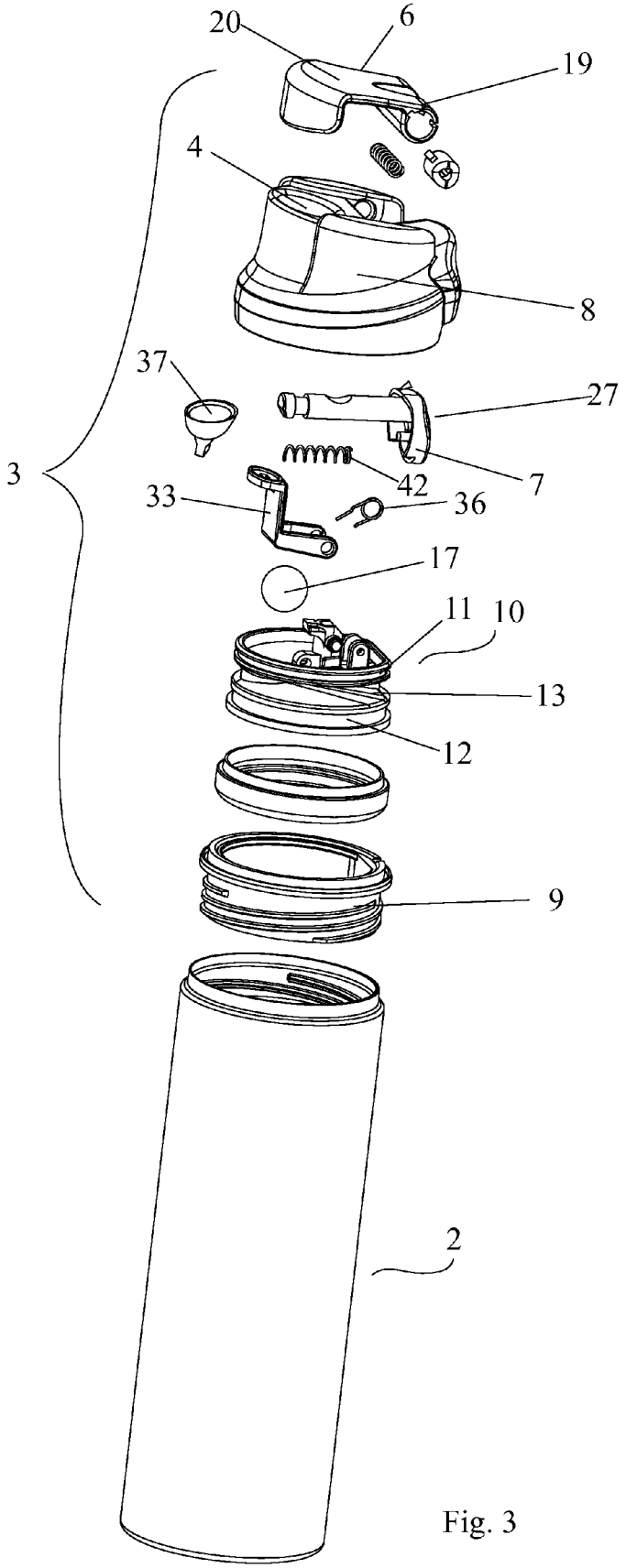
FIG. 3 is an exploded perspective view of a container according to an embodiment of the present invention.
Figure 5:
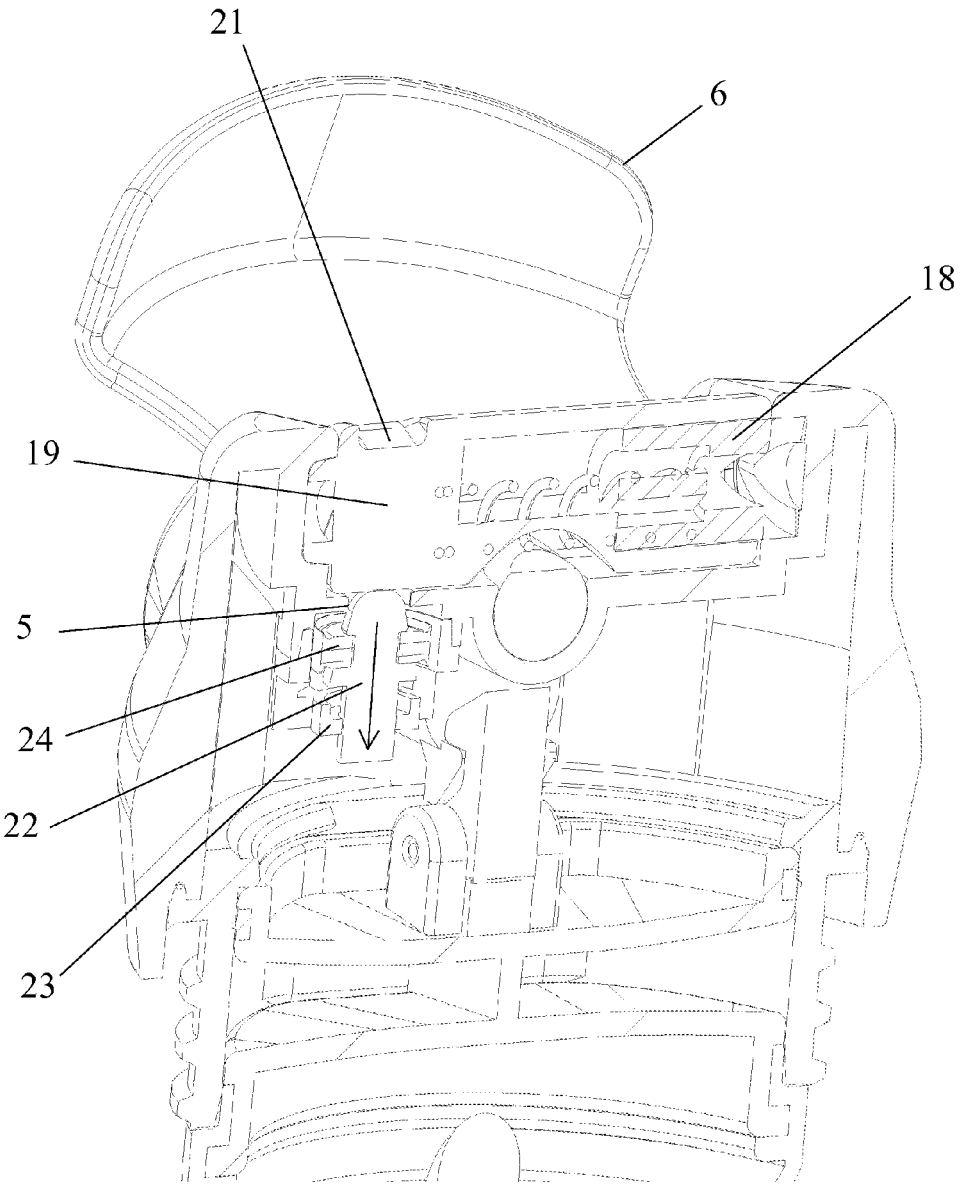
FIG. 5 is a perspective view of the container taken along line A-A of FIG. 1B.
Figure 6:
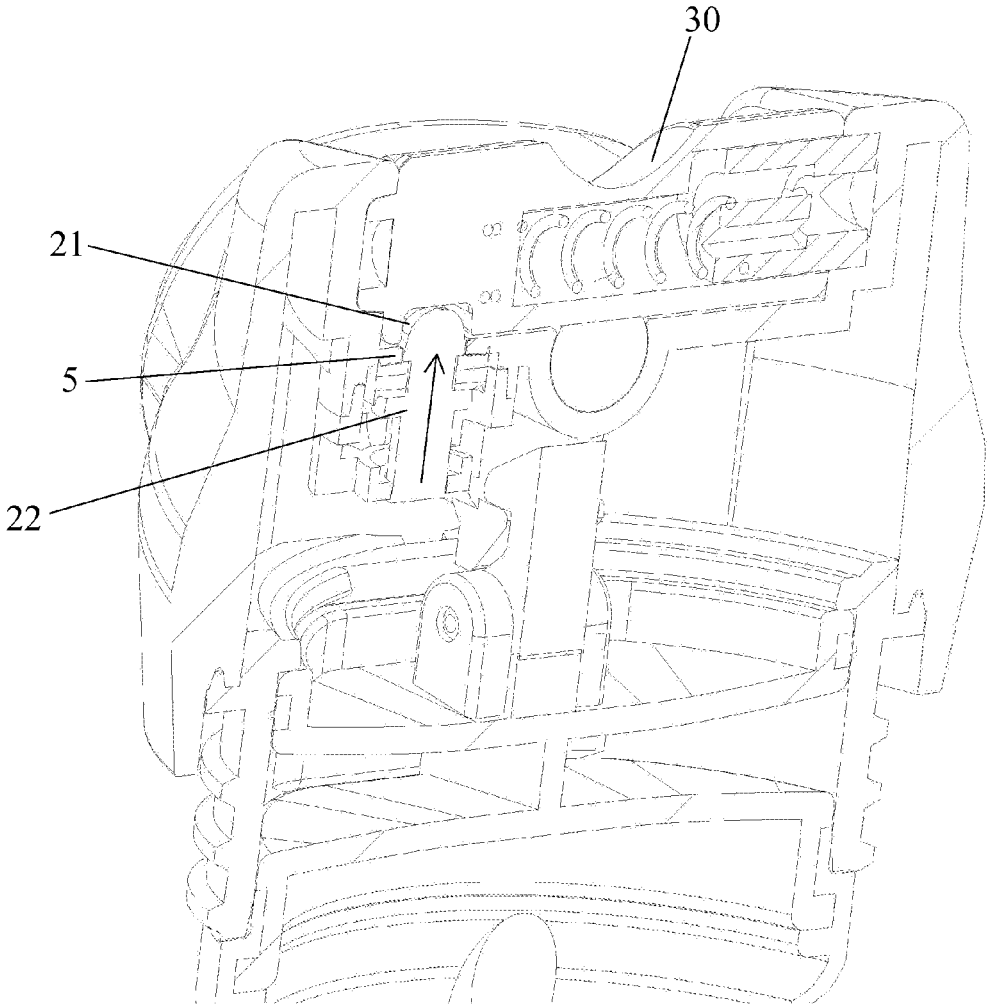
FIG. 6 is a perspective view of the container taken along line B-B of FIG. 1A.

As can be seen in FIGS. 3, 5 and 6, the drinking orifice 4 and the gas vent 5 are formed through a top surface of the upper lid member 8. The closure member 6 comprises a hinge 19 configured as a substantially cylindrical sleeve in this embodiment, and a closure plate 20 extending from a wall of the hinge 19 in a plane parallel to an axis of the hinge 19. The closure member 6 is mounted on the top surface of the upper lid member 8 in such a manner that the closure member 6 is able to pivot around the axis of the hinge 19 by about 180 degrees, between the fully closed position and the fully open position. In this embodiment, the gas vent 5 is formed with an opening direction thereof perpendicular to a longitudinal direction of the hinge 19. In other words, the gas vent 5 is formed perpendicular to the top surface of the upper lid member 8. A niche 21 is formed on the wall of the hinge 19 and positioned right above the gas vent 5. The niche 21 is configured to face the gas vent 5 when the closure member 6 is in the closed position and rotate away from the gas vent 5 when the closure member 6 moves to the open position.

A pin 22 is slidably supported by a holder 23 secured below the gas vent 5 to an inner surface of the upper lid member 8 and protrudes beyond the upper lid member 8 through the gas vent 5, and is received in the niche 21 when the closure member 6 is in the closed position. A silicon resilient ring 24 surrounding the pin 22 serves as a resilient member applying an upward pressure on the pin 22, causing the pin 22 to move up and block the gas vent 5. The niche 21 rotates to face away from the gas vent 5 along with the pivotal movement of the closure member 6, and therefore the wall of the hinge 19 presses to cause the pin 22 to move downwardly away from the gas vent 5, creating a venting space between the pin 22 and the gas vent 5, which venting space allows the gas within the lid assembly 3 to exit.

Figure 7:
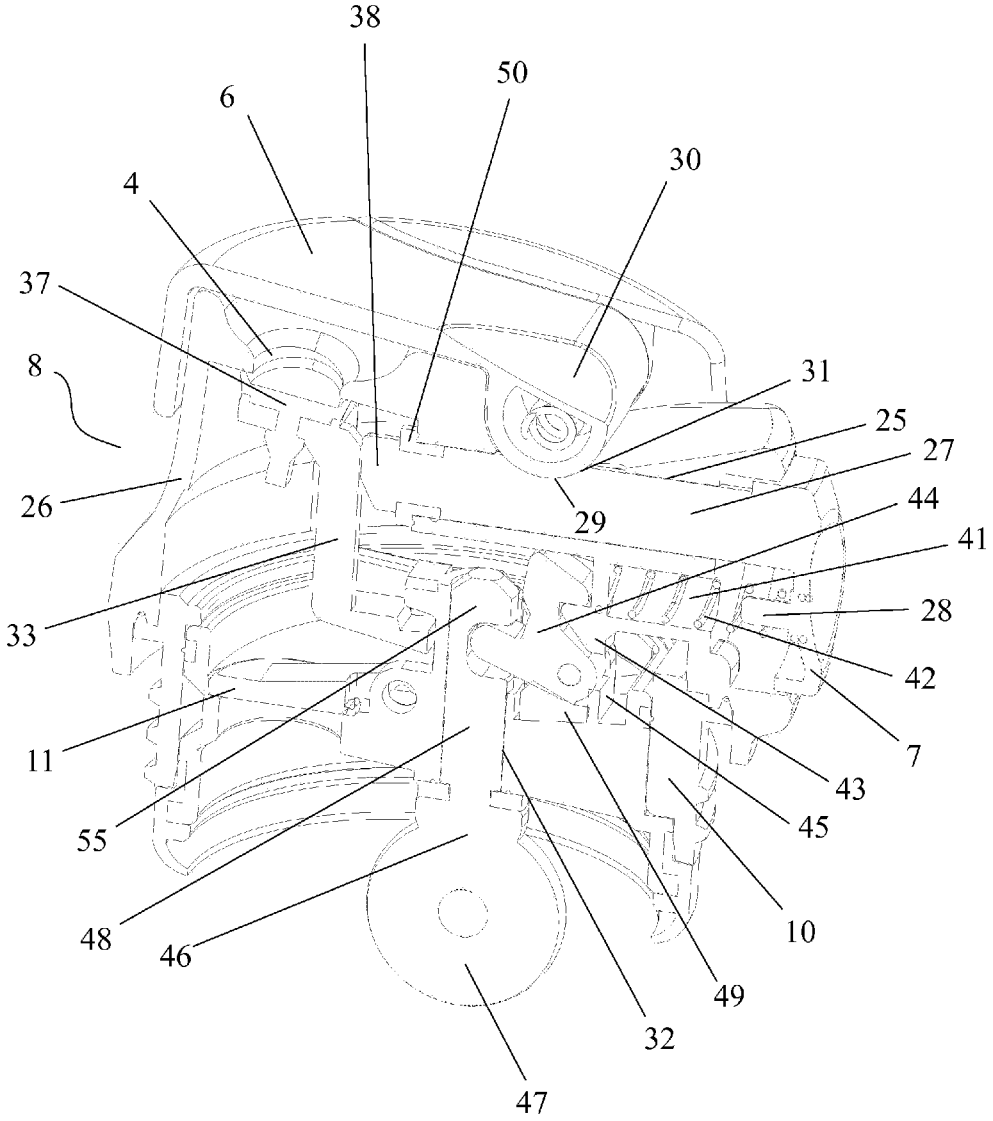
FIG. 7 is a perspective view of the container taken along line C-C of FIG. 1A.
Figure 8:
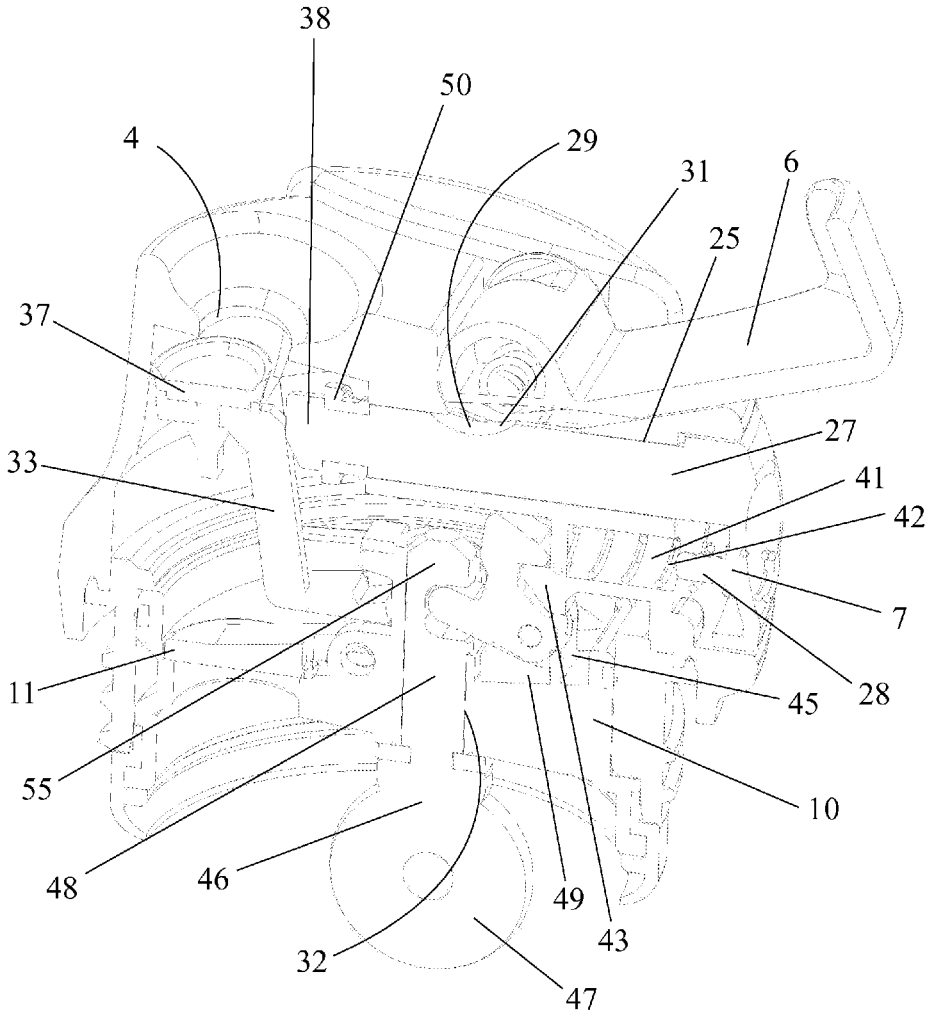
FIG. 8 is a perspective view of the container taken along line D-D of FIG. 1C.
Figure 9:
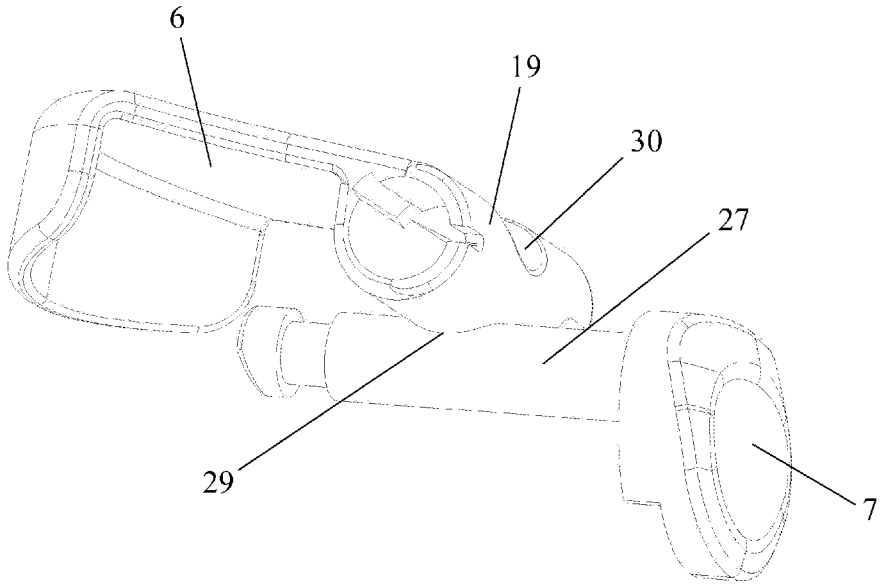
FIG. 9 is a perspective view of the closure member and the piston head according to an embodiment of the present invention with the gas vent in the closed position.
Figure 10:
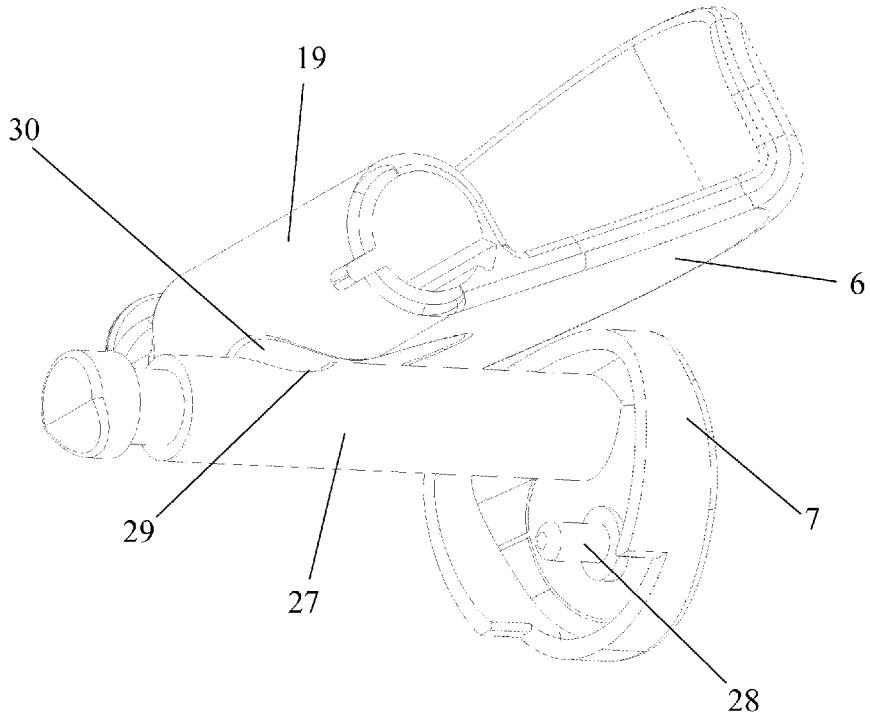
FIG. 10 is a perspective view of the closure member and the piston head of FIG. 9 with the gas vent in the open position.

As shown in FIGS. 7-10, the upper lid member 8 further comprises a piston passage 25 extending horizontally through a side wall 26 of the upper lid member 8. The piston head 7 of the piston 27 is arranged to expose externally, and the piston 27 extends through the piston passage 25 and is displaceable within the piston passage 25 when the piston head 7 is pressed. Preferably, a piston seal 50 is provided on the piston 27 to prevent the liquid and gas from escaping from the container 1 through the piston passage 25. A lateral recess 30 is formed in the middle of the wall of the hinge 19 on a side opposite to the niche 21. Preferably, the recess 30 extends onto the closure plate 20. An opening 31 is formed on an upper side of the piston passage 25 and positioned to correspond to the recess 30 to allow for a part of the hinge 19 protruding beyond the opening 31. A lateral groove 29 is formed on an upper side of the piston 27 and also positioned to correspond to the opening 31. The lateral recess 30 and the lateral groove 29 are such arranged that the lateral recess 30 is adapted to face away from the lateral groove 29 and a part of the closure member 6 protrudes beyond the opening 31 to be housed in the lateral groove 29 for prevention of the displacement of the piston relative to the piston passage 25 when the gas vent is closed, as shown in FIGS. 7 and 9; and the lateral recess 30 is adapted to face the lateral groove 29 to allow for the movement of the piston 27 when the closure member 6 is moved to open the gas vent 5, as shown in FIGS. 8 and 10. In other words, when the closure member 6 is in the closed position, the piston head 7 cannot be pressed. Therefore, only when the closure member 6 is in the open position will the user be able to press the piston head 7 to move the piston 27.

As shown in FIGS. 4, 7, 8 and 11, a hollow cylinder 32 is formed integrally with the lower lid member 10 and extends through both the upper plate 11 and the lower plate 12. As shown in FIG. 11, a L-shaped lever 33 is pivotally mounted on the cylinder 32 by inserting two stubs 34 extending from opposite outer surfaces of the cylinder 32 into respective holes 35 of two spaced apart legs at a lower end of the lever 33. A torsion spring 36 is provided to constantly apply an upward pressure to the lever 33.

A baffle plate 37, preferably made of rubber, for closing the drinking orifice 4 is mounted atop an upper end of the lever 33, and moves pivotally along with the pivotal movement of the lever 33. The piston 27 has an inner end 38 in abutment against the upper end of the lever 33. As shown in FIG. 7, the baffle plate 37 is pressed against the drinking orifice 4 under the action of the torsion spring 36 to close the drinking orifice 4. As shown in FIG. 8, when the piston head 7 is pressed by the user, the piston 27 moves inwardly along a longitudinal direction of the piston passage 25, and the inner end 38 of the piston 27 pushes to cause the lever 33 to pivot downwardly with the baffle plate 37 carried thereon, thereby to drive the movement of the baffle plate 37 away from the drinking orifice 4. In this way the drinking orifice 4 is opened by the pressing of the piston head 7, allowing the liquid comes out from the container 1. As described above, the piston 27 is permitted to enable the pivotal movement of the lever 33 only when the closure member 6 is moved to open the gas vent, that is, when the closure member 6 is in the open position.

As shown in FIGS. 7 and 8, a spring chamber 41 is formed integrally with the upper lid member 8 below the piston passage 25, and a piston spring 42 is accommodated in the spring chamber 41. The piston spring 42 is configured to constantly apply an outward pressure to the piston head 7, that is, against the force exerted by the user pressing the piston head 7. When the piston head 7 is released and returns by the piston spring 42 to its original position, the lever 33 is forced to pivot upwardly by the torsion spring 36 until the baffle plate 37 returns to a position for closing the drinking orifice 4. A bulge 28 (see FIGS. 7, 8 and 10) extends from an inner surface of the piston head 7 into the spring chamber 41 to facilitate to restrain the displacement of the piston head 7 in the longitudinal direction of the piston 27.

In order for a detachable structure of the lid assembly 3, a lock mechanism is provided, which comprises a hook member 43, a hook linkage 44 and an unlocking member 46. The hook member 43 is formed integrally with and extends downwardly from the spring chamber 41 of the upper lid member 8. The hook linkage 44 is pivotally mounted on a post 45 integral with the upper plate 11 of the lower lid member 10 and is positioned between the hook member 43 and the unlocking member 46. The unlocking member 46 comprises a grip portion 47 restrained below the lower lid member 10, and a body 48 extending upwardly from the grip portion 47 through the cylinder 32 and having a hooked head 55 in engagement with one hooked end of the hook linkage 44, the other hooked end of the hook linkage 44 engages with the hook member 43. Also, it is possible that a respective slot may be formed on opposite side surfaces of the hook linkage 44 to engage with the hook member 43 and the hooked head 55 respectively for the same locking purpose. A resilient silicon block 49 is placed below the hook linkage 44 to constantly force the hook linkage 44 to pivot upwardly, that is, forcing the hook linkage 44 to be into engagement with the hook member 43. The engagement between the hook member 43 and the hook linkage 44 results in the lower lid member 10 secured to the upper lid member 8. To detach the lower lid member 10 from the upper lid member 8, for example, for the sake of cleaning, the grip portion 47 may be pulled downwardly drive the hooked head 55 to move down, which in turns causes the hook linkage 44 to pivot downwardly and to disengage from the hook member 43. In this way, the lower lid member 10 can be detached from the upper lid member 8. The lower lid member 10 and upper lid member 8 can also be easily assembled together by bringing them towards each other until the hook linkage 44 is forced to engage with the hook member 43.

Figure 14A:
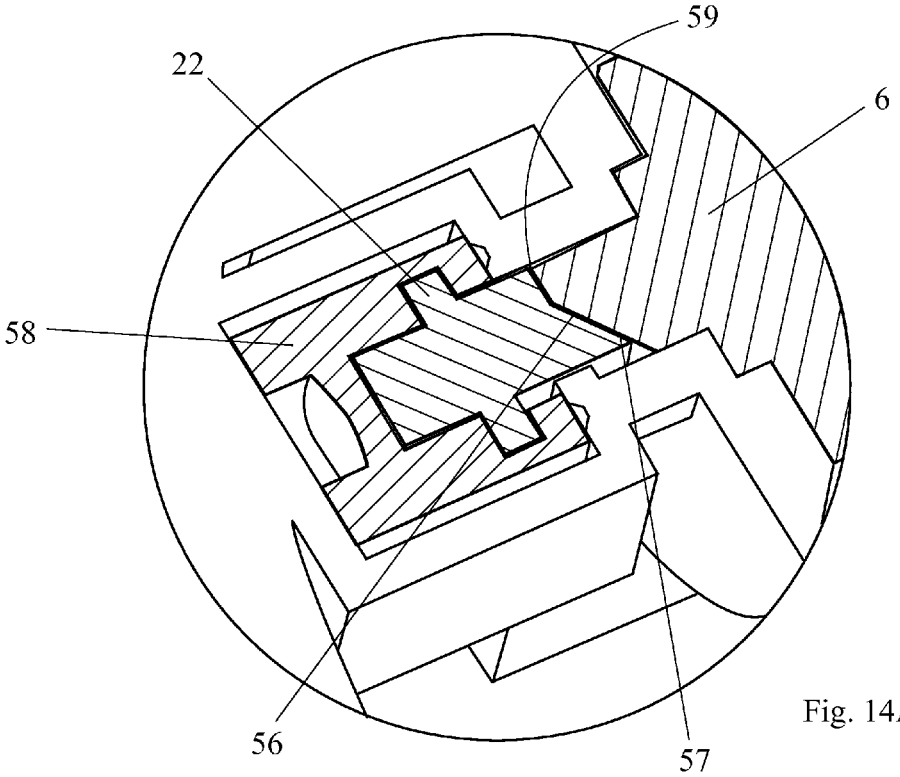
FIG. 14A is an enlarged partial cross-sectional view of the closure member and the pin shown in FIG. 13A.
Figure 14B:
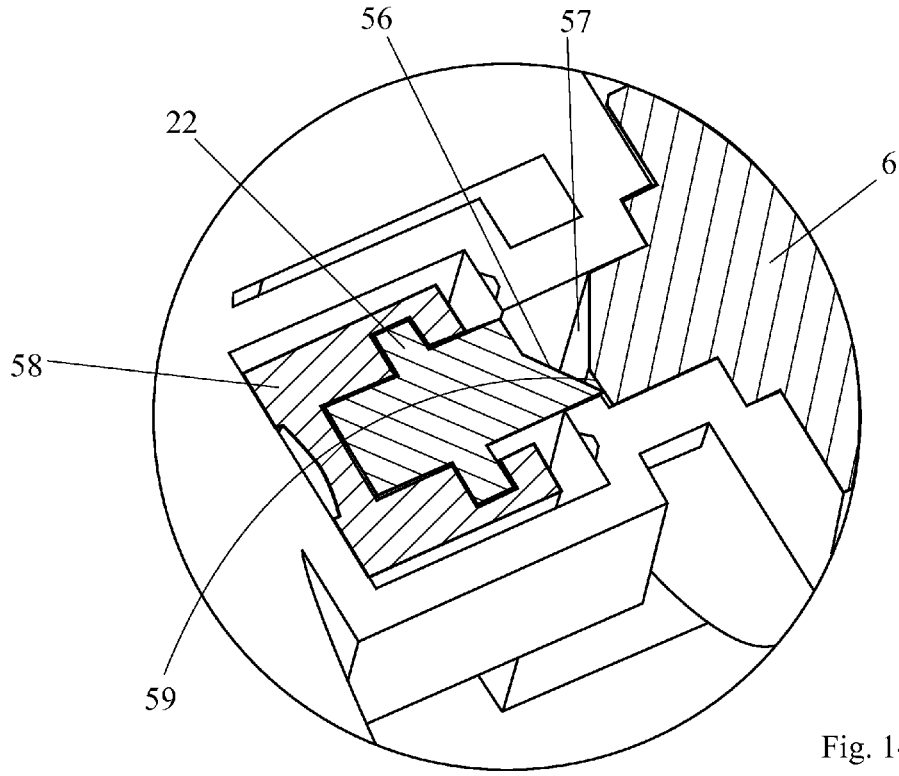
FIG. 14B is an enlarged partial cross-sectional view of the closure member and the pin shown in FIG. 13B.

FIGS. 12A-14B show a second preferred embodiment of the present invention, this embodiment is structurally similar to the first embodiment discussed above, except for the arrangement of the gas vent 5. As illustrated, the gas vent 5 is formed parallel to the top surface of the upper lid member 8. In other words, the gas vent 5 is formed with an opening direction thereof in parallel with the longitudinal direction of the hinge 19. The pin 22 has a first cam face 56 formed on an end thereof adjacent to the closure member 6. Correspondingly, the closure member 6 has a second cam face 57 formed on an end of the hinge 19 facing towards the pin 22. Like the silicon resilient ring 24 discussed in the first embodiment, a resilient silicon member 58 is coupled to the other end of the pin 22 and is pressed to move the pin 22 in the direction towards the gas vent 5 until the gas vent 5 is blocked by the pin 22. The pin 22 protrudes beyond the gas vent 5 with the first cam face 56 of the pin 22 in abutment against and in corporation with the second cam face 57 of the hinge 19 of the closure member 6, thereby to achieve the closing of the gas vent 5, as shown in FIGS. 13A and 14A. A flat surface 59 of the hinge 19 adjoins the second cam face 57 and rotates with the pivotal movement of the closure member 6 to force against the first cam face 56 of the pin 22, with a result of at least a part of the pin 22 is pushed to move away from the gas vent, as shown in FIGS. 13B and 14B. This would create a venting space between the pin 22 and the gas vent 5, which venting space allows the gas within the container to come out of the lid assembly 3.

FIGS. 15A-15D show a third preferred embodiment of the present invention, which is structurally similar to the first embodiment described above, except for the blocking member 17, the window 14 and the lock mechanism. In this third embodiment, a hollow cylinder 65 extends through the window 14 and is secured within the window 14 by a plurality of connectors 66 formed on an inner surface of the window 14. The blocking member 17 has a stem 60 extending through the hollow cylinder 65, a top flange 61 extending from one end of the stem 60 and having a diameter greater than the stem 60, and a bottom flange 62 extending from the other end of the stem 60 and sized to fully cover the window 14. A blocking ring 67 is secured on top of the bottom flange 62. A constricted spring 63 is coiled about an upper part of the stem 60 and carried between a top surface of the hollow cylinder 65 and the top flange 61, and constantly applies an upward pressure to the top flange 61 of the blocking member 17, such that the blocking ring 67 is pressed against a bottom surface of the lower lid member 10 to block the window 14. A lower part of the stem 60 is allowed to slide vertically within the hollow cylinder 65 which servers to guide the movement of the stem 60. When the piston head 7 is pressed to force the piston 27 to move inwardly, which in turn forces the lever 33 to pivot downwardly, the lever 33 presses on the top flange 61 and forces the blocking member 17 to move downwardly, causing the blocking ring 67 to move away from the bottom surface of the lower lid member 10, allowing liquid to flow from the cavity 53 into the lid assembly 3 and to be drunk by the user through the drinking orifice 4.

Figure 15A:
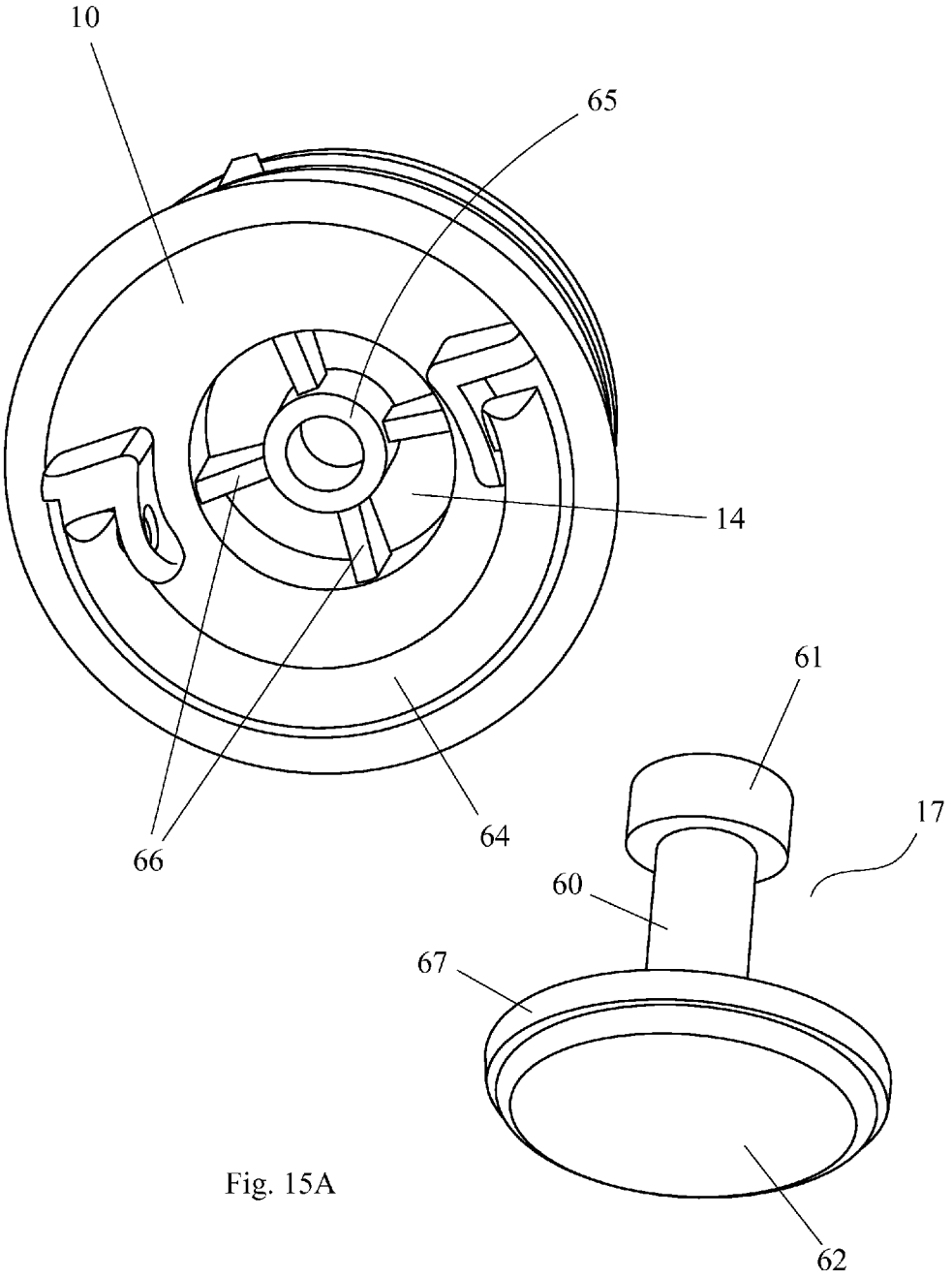
FIG. 15A is an exploded bottom perspective view of a lower lid member and a blocking member according to a third embodiment of the present invention.
Figure 15B:
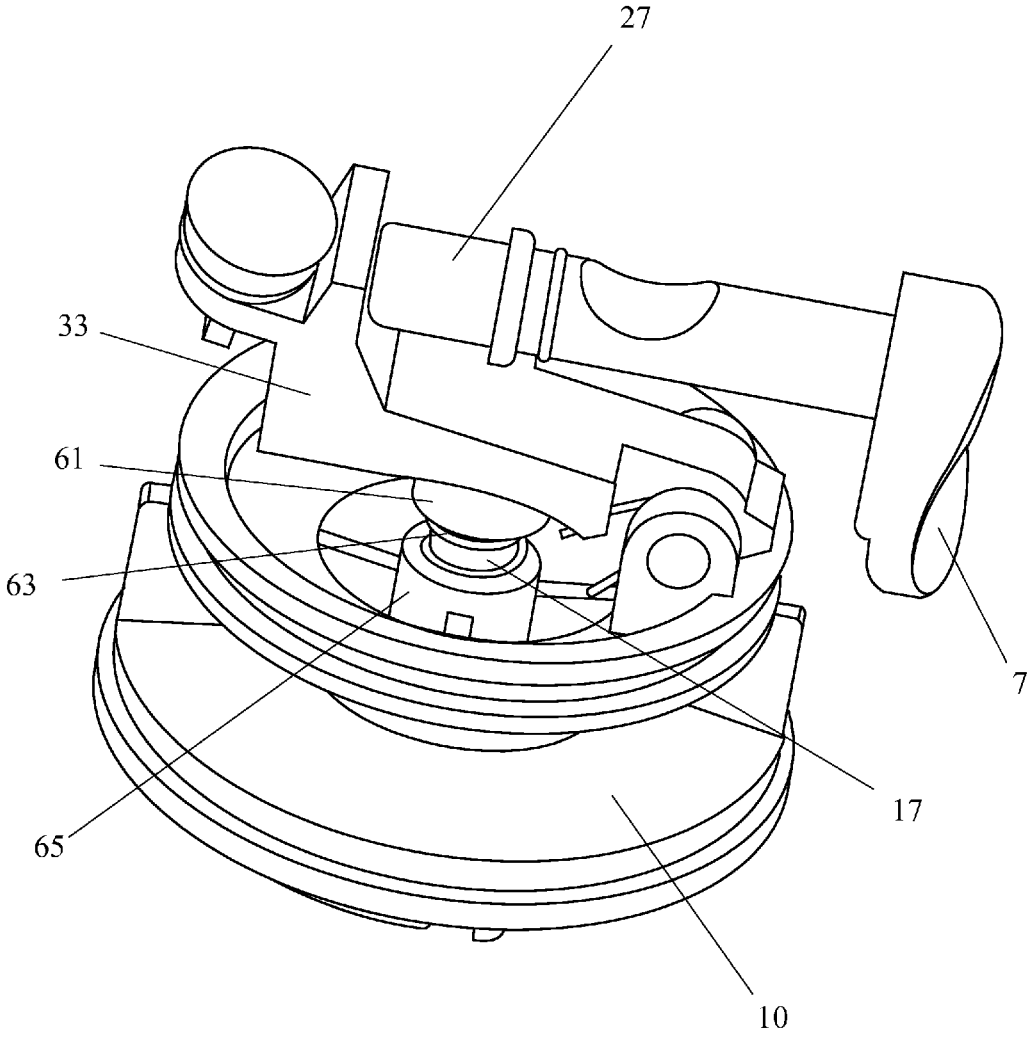
FIG. 15B is a top perspective view of the lid assembly according to the third embodiment of the present invention with the upper lid member and the closure member removed.
Figure 15C:
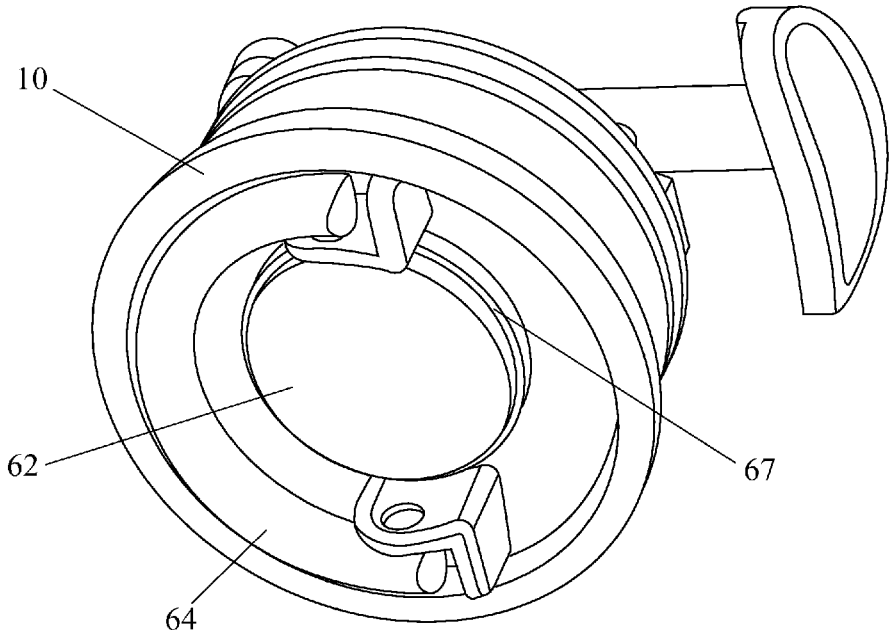
FIG. 15C is a bottom perspective view of the lid assembly shown in FIG. 15B with the handle in the resting position.
Figure 15D:
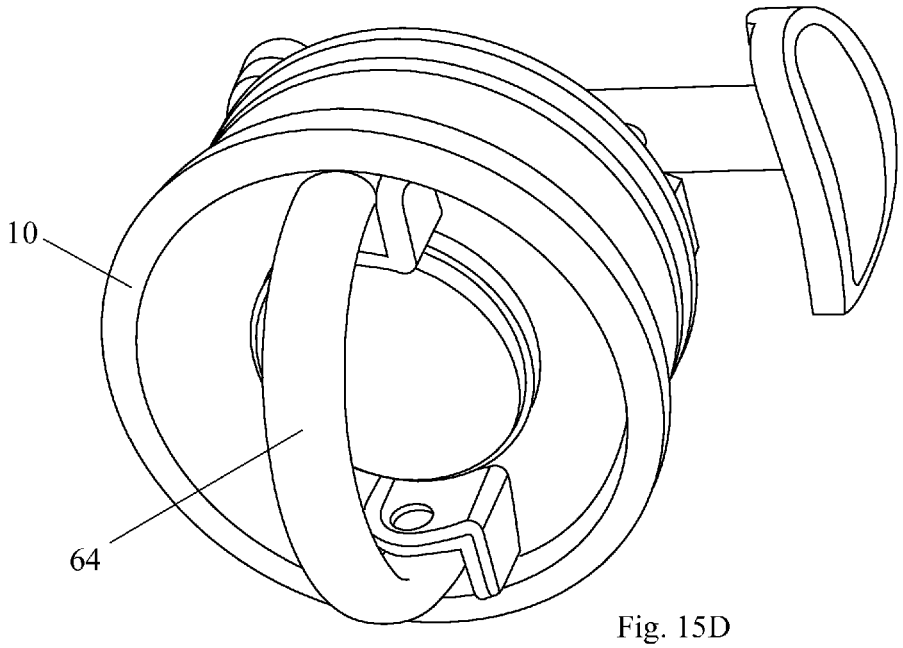
FIG. 15D is a bottom perspective view of the lid assembly shown in FIG. 15B with the handle in the ready-to-use position.
Figure 16A:
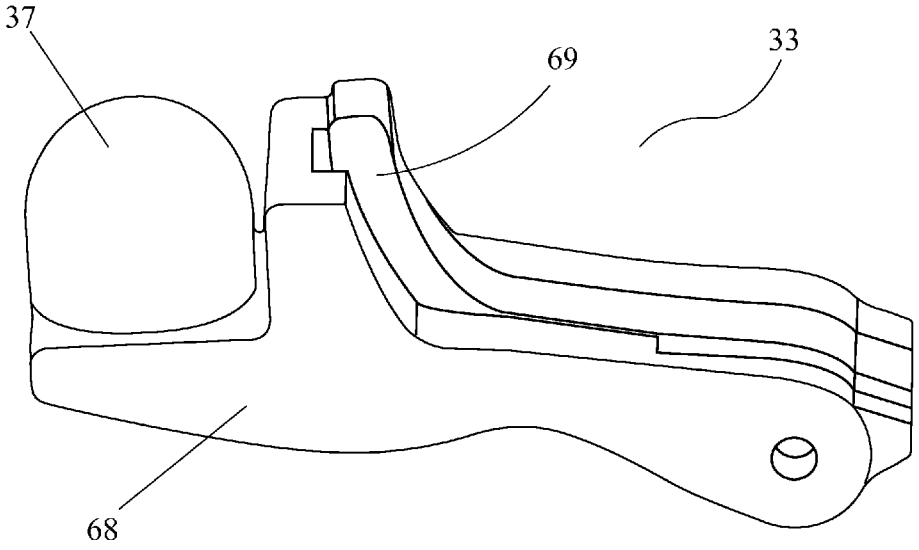
FIG. 16A is a top perspective view of a lever according to a fourth embodiment of the present invention.
Figure 16B:
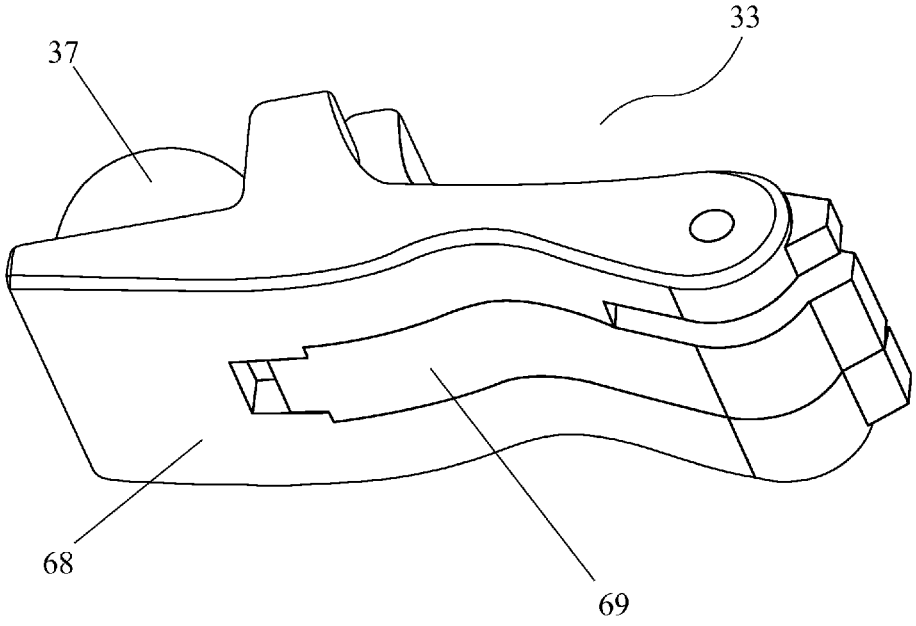
FIG. 16B is a bottom perspective view of the lever shown in FIG. 16A.
Figure 16C:
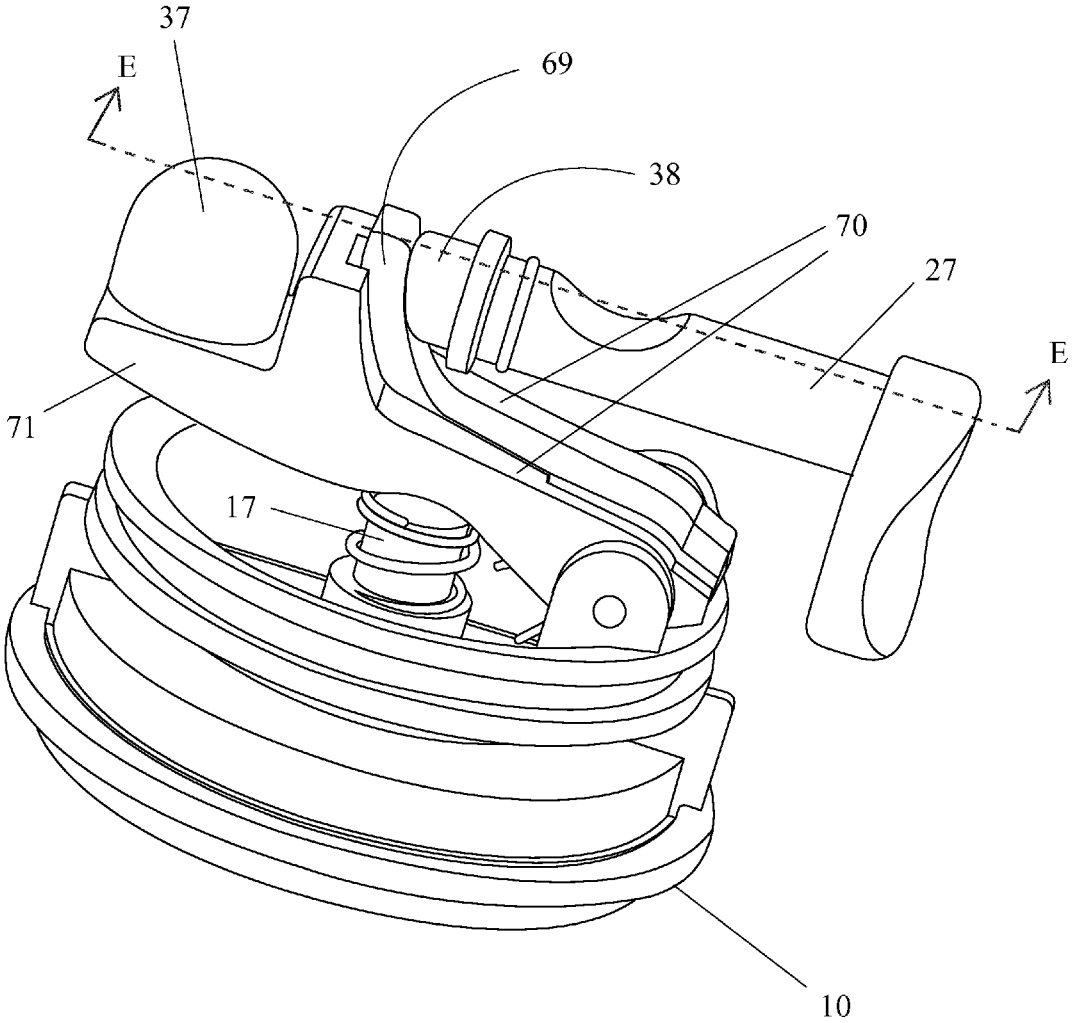
FIG. 16C is a top perspective view of the lid assembly according to the fourth embodiment of the present invention with the upper lid member and the closure member removed.
Figure 16D:
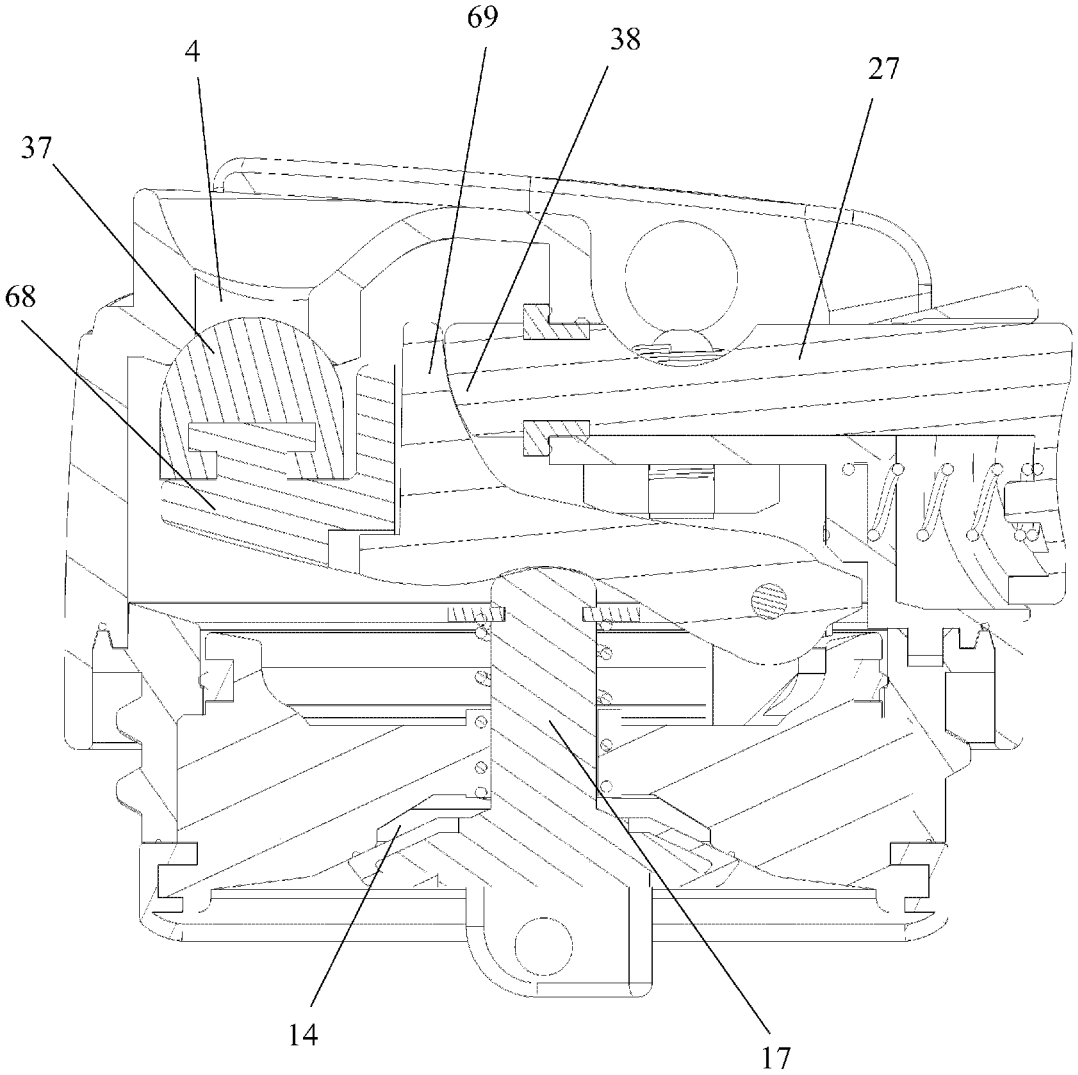
FIG. 16D a cross sectional view of the lid assembly taken along line E-E of FIG. 16C with the window and the drinking orifice blocked.
Figure 16E:
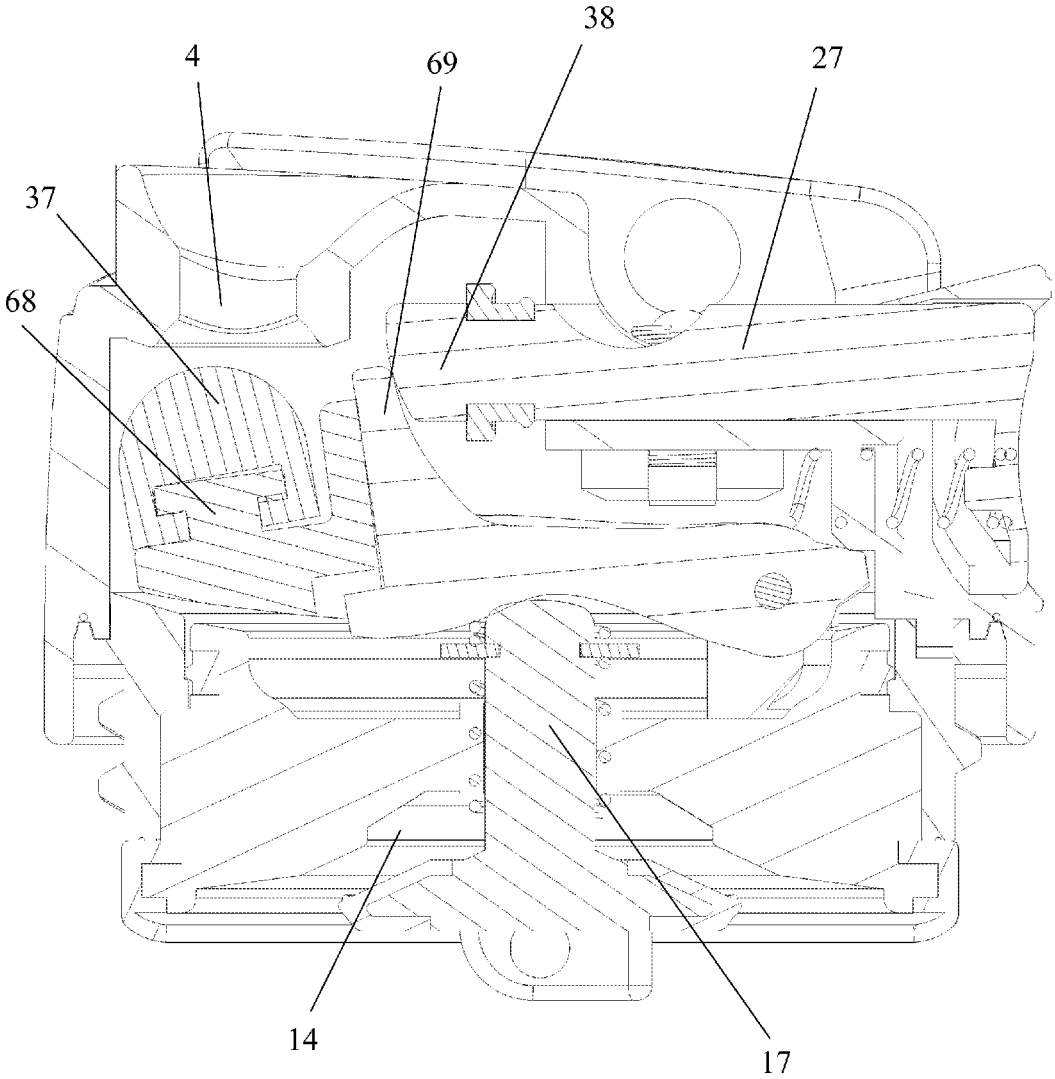
FIG. 16E a cross sectional view of the lid assembly taken along line E-E of FIG. 16C with the window and the drinking orifice opened.

For the sake of simplicity, the lock mechanism described above in the first embodiment is not present in this third embodiment, and the upper lid member 8 and the lower lid member 10 are attached to each other in a conventional detachable manner, for instance by cooperating threads or by snap-fit. As shown in FIGS. 15A, 15C and 15D, in this embodiment, a handle 64 is pivotally mounted to a bottom surface of the lower lid member 10 to facilitate detachment of the lower lid member 10 from the upper lid member 8. In a resting position shown in FIGS. 15A and 15C, the handle 64 is positioned parallel and approximate to the bottom surface of the lower lid member 10. When the lid assembly 3 needs to be disassembled, for example, for the purpose of cleaning the inside thereof, the handle 64 can be pivoted to a ready-to-use position wherein the handle 64 is perpendicular to the bottom surface of the lower lid member 10, as shown in FIG. 16D. The user can then pull the handle 64 to detach the lower lid member 10 from the upper lid member 8.

FIGS. 16A-16E show a fourth preferred embodiment of the present invention, which is structurally similar to the third embodiment described above but differs in the structure of the lever 33. In this fourth embodiment, the lever 33 is configured to comprise a first pivoting member 68 and a second pivoting member 69. The first pivoting member 68 comprises an arm 71 on which the baffle plate 37 is mounted, and two spaced apart legs 70 extending from the arm 71. The second pivoting member 69 is insertable and able to pivot in a space defined by the two legs 70. Both the two legs 70 and the second pivoting member 69 are pivotal about a common hinge fixed on the lower lid member 10.

In this embodiment, the second pivoting member 69 protrudes beyond the two legs 70 such that the inner end 38 of the piston 27 moves to act on the second pivoting member 69 only. The second pivoting member 69 is caused by the piston 27 to pivot downwardly in the space defined by the two legs 70 and comes into contact with the top flange 60 of the blocking member 17. Continued downward movement of the second pivoting member 69 causes the blocking member 17 to move downwardly so as to expose the window 14. The first pivoting member 68 remains immobilized and the baffle plate 37 arranged on the arm 71 of the first pivoting member 68 is kept in place while the second pivoting member 69 moves and before the window (14) is exposed. After the window (14) is exposed, the second pivoting member 69 reaches and presses towards the first pivoting member 68 causing the first pivoting member 68 to pivot downwardly together with the second pivoting member 69. As a result, the baffle plate 37 is driven to move away from the drinking orifice 4.

Such a configuration ensures that the window 14 is opened before the drinking orifice 4 is opened. Since the window 14 can be opened only when the gas vent 5 is opened, this embodiment ensures that the hot gas contained in the cavity 53 of the container body 2 is released through the window 14 and the gas vent 5 before the user is able to drink the liquid from the drinking orifice 4, thus preventing the hot gas from spurting at the user.

While the present invention is described in connection with what is presently considered to be the most practical and preferred embodiment, it should be appreciated that the invention is not limited to the disclosed embodiment, and is intended to closure member various modifications and equivalent arrangements included within the spirit and scope of the claims. Modifications and variations in the present invention may be made without departing from the novel aspects of the invention as defined in the claims, and this application is limited only by the scope of the claims.

NUMERICAL REFERENCES

1 container
2 container body
3 lid assembly
4 drinking orifice
5 gas vent
6 closure member
7 piston head
8 upper lid member
9 intermediate bracket
10 lower lid member
11 upper plate
12 lower plate
13 connecting member
14 window
15 main portion
16 notch
17 blocking member
19 hinge
20 closure plate
21 niche
22 pin
23 holder
24 resilient ring
25 piston passage
26 side wall
27 piston
28 bulge
29 groove
30 recess
31 opening
32 cylinder
33 lever
34 stub
35 hole
36 torsion spring
37 baffle plate
38 inner end
39 restraint
40 turning point

41 spring chamber
42 piston spring
43 hook member
44 hook linkage
45 post
46 unlocking member
47 grip portion
48 body
49 resilient block
50 piston seal
51 inner wall component
52 outer wall component
53 cavity
55 hooked head
56 first cam face
57 second cam face
58 silicon resilient member
59 flat surface
60 stem
61 top flange
62 bottom flange
63 constricted spring
64 handle
65 hollow cylinder
66 connector
67 blocking ring
68 first pivoting member
69 second pivoting member
70 leg
71 arm

What is claimed is:

1. A lid assembly (3) for a drinking container (1), the lid assembly (3) comprising:

an upper lid member (8) comprising a drinking orifice (4) and a gas vent (5) formed therethrough;

a closure member (6) pivotally mounted on a top surface of the upper lid member (8) for pivotal movement to close and open the gas vent (5);

a lower lid member (10) having a window (14) to allow a flow of liquid and gas therethrough, said window in fluid communication with the drinking orifice (4) and the gas vent (5);

a lever (33) pivotally mounted on the lower lid member (10);

a baffle plate (37) for closing the drinking orifice (4) and mounted atop the lever (33) to move pivotally along with the pivotal movement of the lever (33); and a piston (27) movable within the upper lid member (8) in a direction in order to force the lever (33) to pivot downwardly so that the baffle plate (37) moves away from the drinking orifice (4), said piston (27) having a piston head (7) exposed externally;

wherein the piston (27) is configured such that the piston (27) is permitted to enable the pivotal movement of the lever (33) only when the closure member (6) is moved to open the gas vent (5).

2. The lid assembly (3) of claim 1, wherein the piston (27) extends through a piston passage (25) formed through a side wall (26) of the upper lid member (8), and is configured such that an inner end (38) of the piston (27) abuts against the lever (33) and moves to force the lever (33) to pivot downwardly.

3. The lid assembly (3) of claim 2, wherein a torsion spring (36) is provided to constantly apply an upward pressure to the lever (33).

4. The lid assembly (3) of claim 2, wherein a groove (29) is formed on an upper side of the piston (27), and an opening (31) is formed on an upper side of the piston passage (25) and positioned to correspond to the groove (29) so as to allow for housing of a part of the closure member (6) in the groove (29) for prevention of the movement of the piston (27) when the gas vent (5) is closed; and a recess (30) formed on the closure member (6) is adapted to face away from the groove (29) when the gas vent (5) is closed, and adapted to face the groove (29) to allow for the movement of the piston (27) when the closure member (6) is moved to open the gas vent (5).

5. The lid assembly (3) of claim 1, wherein a piston spring (42) is provided to constantly apply an outward pressure to the piston head (7).

6. The lid assembly (3) of claim 1, wherein the closure member (6) comprises a hinge (19) and a closure plate (20) extending from the hinge (19), the closure member (6) mounted on the top surface of the upper lid member (8) in such a manner that the closure plate (20) is pivotal around the hinge (19).

7. The lid assembly (3) of claim 6, wherein the gas vent (5) is formed with an opening direction thereof perpendicular to a longitudinal direction of the hinge (19), and the lid assembly (3) comprises a pin (22) protruding beyond the gas vent (5) and received in a niche (21) formed on the hinge (19) to close the gas vent (5), and the pin (22) being caused to disengage from the niche (21) by the pivotal movement of the closure member (6) and pressed by the closure member (6) to move down away from the gas vent (5) to create a venting space together with the gas vent (5).

8. The lid assembly (3) of claim 7, wherein the pin (22) is slidably supported by a holder (23) secured below the gas vent (5) to an inner surface of the upper lid member (8), and a resilient ring (24) is provided to surround the pin (22) and push the pin (22) to move up when pressed.

9. The lid assembly (3) of claim 6, wherein the gas vent (5) is formed with an opening direction thereof in parallel with a longitudinal direction of the hinge (19), the lid assembly (3) comprises a pin (22) protruding beyond the gas vent (5) and having a first cam face (56) in corporation with a second cam face (57) formed on an end of the hinge (19) to close the gas vent (5), wherein a flat surface of the hinge (19) adjoining the second cam face (57) rotates with the pivotal movement of the closure member (6) to force against the first cam face (56) of the pin (22), so that at least a part of the pin (22) is pushed to move away from the gas vent (5) to create a venting space together with the gas vent (5).

10. The lid assembly (3) of claim 9, wherein a resilient member (58) is coupled to an opposite end of the pin (22) to the first cam face (56) in order to operably push the pin (22) towards the gas vent (5).

11. The lid assembly (3) of claim 1, wherein the lower lid member (10) is mounted to the upper lid member (8) in a detachable manner.

12. The lid assembly (3) of claim 11, wherein the lid assembly (3) further comprises a lock mechanism for detachably locking the upper and lower lid members together.

13. The lid assembly (3) of claim 12, wherein the lock mechanism comprises a hook member (43) extending downwardly from the upper lid member (8); an unlocking member (46) comprising a body (48) extending through the lower lid member (10) and having a hooked head (55), and a grip portion (47) extending from the body and restrained below the lower lid member (10); and a hook linkage (44) pivotally mounted on the lower lid member (10) and between the hook member (43) and the unlocking member (46), the hook linkage (44) configured to have a respective slot formed on opposite side surfaces thereof or have a respective hooked end on opposite ends thereof, which are engagable with the hook member (43) and the hooked head (55); wherein a downward movement of the grip portion (47) drives the hooked head (55) to cause the hook linkage (44) to pivot downwardly and to disengage from the hook member (43) to allow the lower lid member (10) to be detached from the upper lid member (8).

14. The lid assembly (3) of claim 13, wherein a resilient block (49) is placed below the hook linkage (44) to apply an upward pressure to the hook linkage (44).

15. The lid assembly (3) of claim 11, wherein a handle (64) is pivotally mounted to a bottom surface of the lower lid member (10) to facilitate detachment of the lower lid member (10) from the upper lid member (8).

16. The lid assembly (3) of claim 1, wherein the window (14) comprises a main portion (15) and a notch (16), and a blocking member (17) is seated on the window (14) and dimensioned so as to block the main portion (15) with the notch (16) remaining open.

17. The lid assembly (3) of claim 16, wherein a restraint (39) having a profile matchable with the blocking member (17) is provided for restraining the movement of the blocking member (17).

18. The lid assembly (3) of claim 1, comprising a blocking member (17) having a stem (60) extending through the window (14), a top flange (61) extending from one end of the stem (60), a bottom flange (62) extending from the other end of the stem (60) and sized to fully cover the window (14), and a constricted spring (63) coiled about the stem (60) and carried on the stem (60) below the top flange (61) so that it acts to bias the bottom flange (62) to fully cover the window (14), wherein the top flange (60) comes into contact with the lever (33) and is caused to move downwardly when the lever (33) is forced to pivot downwardly by the piston (27), thereby driving to move the bottom flange (62) away from the window.

19. The lid assembly (3) of claim 18, wherein a hollow cylinder (65) for allowing passage of a lower part of the stem (60) is secured within the window (14) by a plurality of connectors (66) formed on an inner surface of the window (14), and the hollow cylinder (65) is sized such that the constricted spring (63) coiled about an upper part of the stem (60) is carried between the hollow cylinder (65) and the top flange (61).

20. The lid assembly (3) of claim 18, wherein a blocking ring (67) is secured on top of the bottom flange (62) and is caused to press against a bottom surface of the lower lid member (10) by the constricted spring (63) to block the window (14).

21. The lid assembly (3) of claim 18, wherein the lever (33) is configured to comprise a first pivoting member (68) having an arm (71) on which the baffle plate (37) is mounted, and a second pivoting member (69), wherein the second pivoting member (69) is adapted to be acted on by the piston (27) to pivot downwardly thereby causing downward movement of the blocking member (17) so as to expose the window (14); and the first pivoting member (68) is configured to remain immobilized while the second pivoting member (69) moves to expose the window (14), and after the window (14) is exposed, is caused to pivot downwardly with the baffle plate (37) moving away from the drinking orifice (4).

22. The lid assembly (3) of claim 21, wherein the first pivoting member (68) comprises two spaced apart legs (70) extending from the arm (71) and pivotally mounted on the lower lid member (10); and the second pivoting member (69) protrudes beyond the two legs (70) such that the inner end (38) of the piston (27) moves to act on the second pivoting member (69) only which is caused to pivot downwardly in a space defined by the two legs (70) until the second pivoting member (69) presses towards the first pivoting member (68) causing the first pivoting member (68) to pivot downwardly together.

23. A drinking container (1) comprising a container body (2) in which a cavity (53) is formed, and a lid assembly (3) according to any one of the preceding claims detachably secured on top of the container body (2).

24. The drinking container (1) of claim 23, wherein the container body (2) is of a dual-walled structure comprising an inner wall component (51) and an outer wall component (52).

25. The drinking container (1) of claim 24, wherein the lid assembly (3) further comprises an intermediate bracket (9) secured around a periphery of the low lid member (10) and having external threads formed on an outer surface thereof, which external threads cooperating with internal threads formed on an inner surface of the inner wall component (51) to secure the lid assembly (3) to the container body (2).

* * * * *

UNITED STATES PATENT AND TRADEMARK OFFICE

CERTIFICATE OF CORRECTION

PATENT NO. : 9,392,892 B2
APPLICATION NO. : 14/517659
DATED : July 19, 2016
INVENTOR(S) : Siu Wah Wong It is certified that error appears in the above-identified patent and that said Letters Patent is hereby corrected as shown below:

On the title page

Item (72) Inventor:

Please change "Sui Wah Wong" to --Siu Wah Wong--

Signed and Sealed this
Twenty-third Day of August, 2016

Michelle K. Lee

Michelle K. Lee
*Director of the United States Patent and Trademark Office*